US010695924B2

(12) United States Patent
Zak et al.

(10) Patent No.: US 10,695,924 B2
(45) Date of Patent: Jun. 30, 2020

(54) SHAVING APPARATUS

(71) Applicant: Hybrid Razor LTD, Caesarea (IL)

(72) Inventors: Shoham Zak, Givat Ela (IL); Beni Nachon, Haifa (IL); Gil Perlberg, Zichron Yaakov (IL); Aviad Dotan, Qoranit (IL)

(73) Assignee: HYBRID RAZOR LTD. (IL)

( * ) Notice: Subject to any disclaimer, the term of this patent is extended or adjusted under 35 U.S.C. 154(b) by 0 days.

(21) Appl. No.: 16/094,507

(22) PCT Filed: Apr. 20, 2017

(86) PCT No.: PCT/IB2017/000527

§ 371 (c)(1),
(2) Date: Oct. 18, 2018

(87) PCT Pub. No.: WO2014/191844

PCT Pub. Date: Dec. 4, 2014

(65) Prior Publication Data

US 2019/0118396 A1 Apr. 25, 2019

Related U.S. Application Data

(60) Provisional application No. 62/325,214, filed on Apr. 20, 2016, provisional application No. 62/325,243,
(Continued)

(51) Int. Cl.
*B26B 19/18* (2006.01)
*B26B 19/16* (2006.01)

(52) U.S. Cl.
CPC ..... *B26B 19/18* (2013.01); *B26B 19/16* (2013.01)

(58) Field of Classification Search
CPC ..... B26B 19/14; B26B 19/16; B26B 19/18
(Continued)

(56) References Cited

U.S. PATENT DOCUMENTS 2,192,726 A * 3/1940 Williams ..... B26B 19/38 30/41.6
4,733,466 A * 3/1988 Fletcher, Jr. ..... B26B 19/141 30/34.2
(Continued)

FOREIGN PATENT DOCUMENTS

JP S5928585 A 2/1984
JP 2011087720 5/2011
(Continued)

OTHER PUBLICATIONS

International Search Report for corresponding Application No. PCT/IB2017/000527, dated Sep. 11, 2017. WO.

*Primary Examiner* — Hwei-Siu C Payer
(74) *Attorney, Agent, or Firm* — The Belles Group, P.C.

(57) ABSTRACT

A shaving apparatus (1000) includes a rotary cutter (220) comprising a cutter tube, the rotary cutter comprising a plurality of closed-geometry apertures (221) in an outer surface of the cutter tube, each of the closed-geometry apertures extending along an aperture axis and comprising: a cutting edge (222); a first section having a first width measured transverse to the aperture axis; a second section having a second width measured transverse to the aperture axis; a waist section having a third width measured transverse to the aperture axis, the waist section located between the first and second sections; and the third width being less than each of the first and second widths; a blade (211) having a cutting edge, the blade mounted adjacent the rotary cutter; and an electric motor (130) operably coupled to a power source and the rotary cutter to rotate the rotary cutter about a rotational axis of the rotary cutter so that a user's hairs are sheared between the cutting edge of the blade and the cutting edges of the cutter.

16 Claims, 25 Drawing Sheets

Related U.S. Application Data filed on Apr. 20, 2016, provisional application No. 62/325,417, filed on Apr. 20, 2016.

(58) Field of Classification Search
USPC ..... 30/41.6, 43.4, 43.5, 43.6, 43.92
See application file for complete search history.

(56) References Cited

U.S. PATENT DOCUMENTS

| | | | | |
|---|---|---|---|---|
| 4,884,338 | A | 12/1989 | Stewart | |
| 5,138,767 | A * | 8/1992 | Locke | B26B 19/04 30/41 |
| 9,862,107 | B2 * | 1/2018 | Perlberg | B26B 19/18 |
| 2002/0020064 | A1 * | 2/2002 | Kunze | B26B 19/16 30/41 |
| 2017/0057103 | A1 * | 3/2017 | Perlberg | B26B 21/34 |
| 2019/0118396 | A1 * | 4/2019 | Zak | B26B 19/18 |

FOREIGN PATENT DOCUMENTS

| | | |
|---|---|---|
| JP | 2013208389 | 10/2013 |
| JP | 2014200425 | 10/2014 |
| WO | WO 2014/191844 A2 * | 12/2014 |
| WO | WO 2017/182872 A1 * | 10/2017 |

* cited by examiner

SHAVING APPARATUS

CROSS-REFERENCE TO RELATED PATENT APPLICATIONS

The present application is a U.S. national stage application under 35 U.S.C. § 371 of International Patent Application Serial No. PCT/IB2017/000527, filed Apr. 20, 2017, which in turn claims the benefit of U.S. Provisional Patent Application Ser. No. 62/325,417, filed Apr. 20, 2016, U.S. Provisional Patent Application Ser. No. 62/325,214, filed Apr. 20, 2016, and U.S. Provisional Patent Application Ser. No. 62/325,243, filed Apr. 20, 2016, the entireties of which are hereby incorporated herein by reference.

BACKGROUND OF THE INVENTION

The present invention relates generally to shaving and specifically to a shaving apparatus that utilizes a shearing technique to cut hair bristles between a rotary cutter and a fixed blade. The current methods for removing hair from the human body, by shaving, as opposed to epilation, involve two basic approaches: the razor approach, wherein a very sharp blade is pushed against the skin at an angle, thereby cutting hair; and the screen approach, wherein a thin fenestrated metal screen is moved across the skin, exposing hair though the holes and cutting them by a mechanized, typically motorized, cutting element.

In the sharp razor blade approach, the energy for cutting is provided by the hand driving the razor across the skin of the user, typically by the hand of the user him/herself. The conditions of cutting hair are a compromise between the ease of cutting a soft (or softened) hair (or hair bristle) and having the necessary counter-force against the blade's force which can only come from the hardness of the hair bristle. Apart from being a compromise difficult to optimize daily on a variety of hair bristles, the sharpness of the blade and its angle pose a constant risk of nicks and cuts, as the blade is driven forcefully across the skin.

In the screen approach of most motorized shaving apparatus, the problem of safety is mitigated since the skin and the cutting elements are separated by the screen. Moreover, the hair bristles which penetrate the screen through its holes are given a prop to be cut against; hence the lack of a counter-force for cutting is also mitigated to some extent. However, in order to arrive at an efficient cutting condition, the hair bristle must enter a hole and be perpendicular to the skin, requirements which are not always met unless the screen is constantly moved across the skin. Still, when the hair bristle is eventually cut at the optimal angle, it cannot be cut close to the skin due to the separating screen.

One cutting technique which requires minimal force for cutting hair can be effected by scissors. Scissors cut hair at the crossing point of two blades which do not have to very sharp in order to cut the hair due to the fact that the blades contact the hair from substantially opposite directions in the plane of cutting, mutually providing each other with a counter-force for cutting. While it is impractical to use scissors for daily shaving, which requires maximal closeness of the cutting point to the skin, the scissors technique was implemented in the form of rotary cutter units cutting hair against a flat and straight stationary blade. This hair cutting technique is capable of providing a very close shave since the cutting blades are positioned flush against the skin at the time of cutting. This also renders this cutting approach relatively safe from accidental cuts.

However, the presently known configurations which have attempted to implement this technique have suffered from a number of drawbacks.

BRIEF SUMMARY OF THE INVENTION

The invention, in one aspect, is directed to a shaving apparatus in which a rotary cutter and a fixed (or substantially fixed) blade are used to shear a user's hairs there between during a shaving process. Rotation of the rotary cutter is driven by an electric motor and the rotary cutter comprises a cutting tube that comprises a plurality of apertures that are defined by cutting edges which form a closed-geometry. The cutting tube may be a tubular screen comprising one or more lattice structures.

In one such embodiment, a shaving apparatus includes a rotary cutter comprising a cutter tube, the rotary cutter comprising a plurality of closed-geometry apertures in an outer surface of the cutter tube, each of the closed-geometry apertures extending along an aperture axis and comprising: a cutting edge; a first section having a first width measured transverse to the aperture axis; a second section having a second width measured transverse to the aperture axis; a waist section having a third width measured transverse to the aperture axis, the waist section located between the first and second sections; and the third width being less than each of the first and second widths; a blade having a cutting edge, the blade mounted adjacent the rotary cutter; and an electric motor operably coupled to a power source and the rotary cutter to rotate the rotary cutter about a rotational axis of the rotary cutter so that a user's hairs are sheared between the cutting edge of the blade and the cutting edges of the cutter.

In another embodiment, a shaving apparatus includes a rotary cutter comprising a cutter tube, the cutter comprising a plurality of closed-geometry apertures in an outer surface of the cutter tube, each of the closed-geometry apertures extending along an aperture axis and comprising: a cutting edge having a shearing portion and a non-shearing portion; a blade having a cutting edge, the blade mounted adjacent the rotary cutter; and an electric motor operably coupled to a power source and the rotary cutter to rotate the rotary cutter about a rotational axis of the rotary cutter so that a user's hairs are sheared between the cutting edge of the blade and the cutting edges of the cutter.

In another embodiment, a shaving apparatus includes a rotary cutter comprising a cutter tube, the cutter tube comprising a plurality of closed-geometry apertures in an outer surface of the cutter tube, each of the closed-geometry apertures comprising: an edge defining the closed-geometry aperture; and wherein at least a cutting portion of the edge is serrated; and a blade having a cutting edge, the blade mounted adjacent the rotary cutter; and an electric motor operably coupled to a power source and the rotary cutter to rotate the rotary cutter about a rotational axis so that a user's hairs are sheared between the cutting edge of the blade and the cutting portions of the edges of the closed-geometry apertures of the cutter.

In another embodiment, a shaving apparatus includes a rotary cutter comprising a plurality of cutting edges; a blade having a cutting edge, the blade mounted adjacent the rotary cutter; an electric motor operably coupled to a power source and the rotary cutter to rotate the rotary cutter about a rotational axis so that a user's hairs are sheared between the cutting edge of the blade and the cutting edges of the rotary cutter; a current sensor configured to sense an amount of current being drawn by the electric motor; and a controller operably coupled to the electric motor and the current sensor, the controller configured to: determine a first operating state of the shaving apparatus from a plurality of potential operating states of the shaving apparatus; compare the amount of current being sensed by the current sensor to an acceptable current range associated with the determined operating state of the shaving apparatus; and activate a user-notification device based on the comparison.

DETAILED DESCRIPTION OF THE INVENTION

Figure 1:
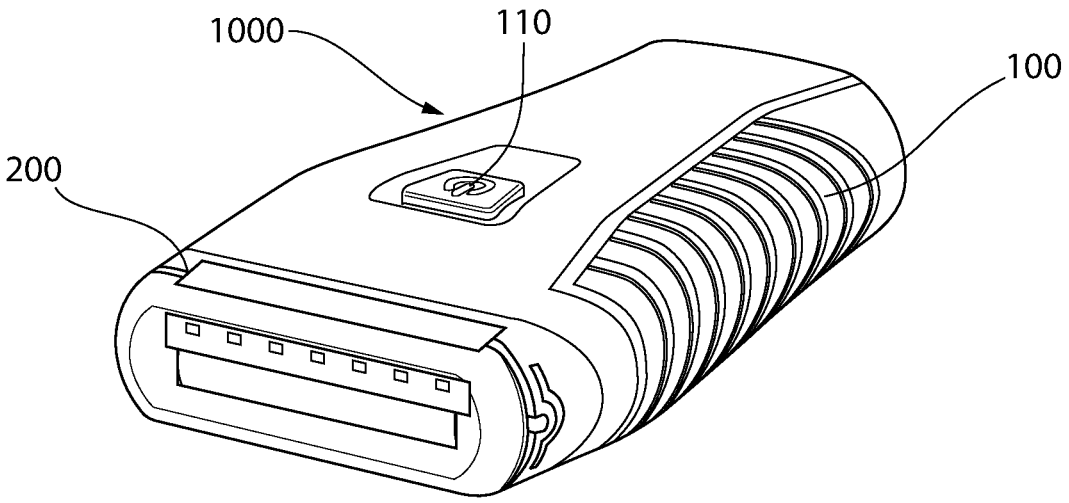
FIG. 1 is a perspective view of a shaving apparatus in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
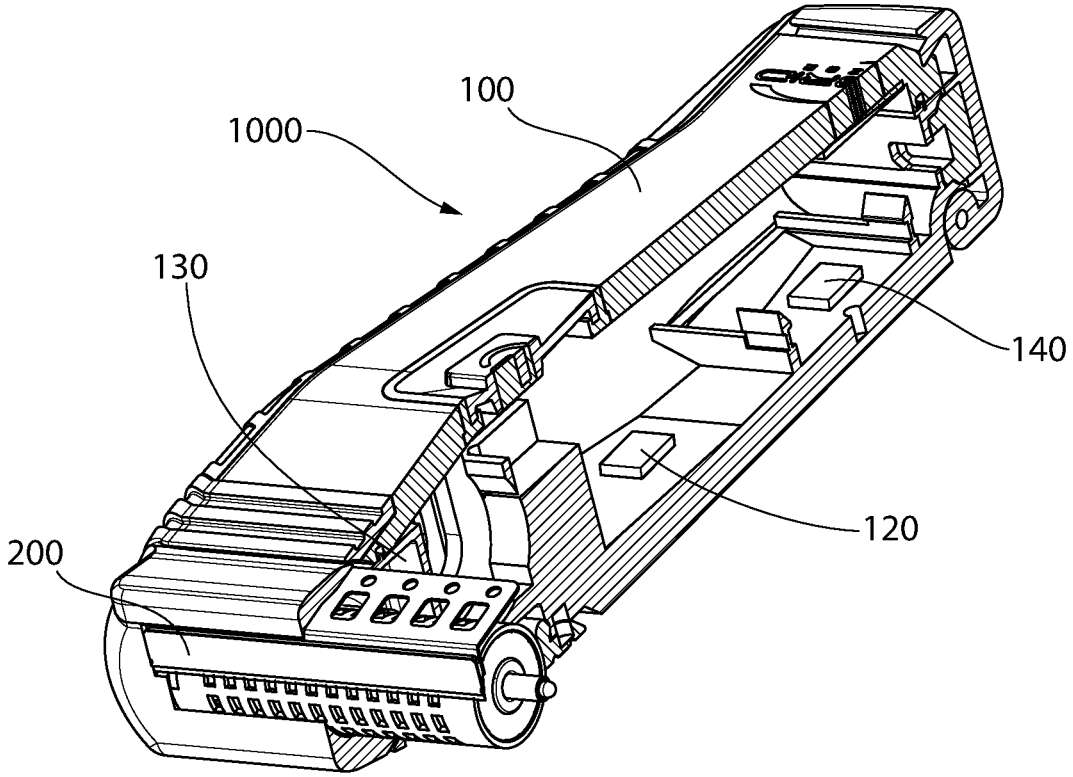
FIG. 2 is a longitudinal partial cross-sectional view of the shaving apparatus of FIG. 1.

FIGS. 1 and 2 show an example of a shaving apparatus 1000 in accordance with embodiments of the invention. The shaving apparatus 1000 generally comprises a handle portion 100 and a head portion 200. The handle portion 100 is used to manipulate the shaving apparatus 1000 during use and provides the user of the shaving apparatus 1000 with the necessary structure to comfortably and firmly grip and maneuver the shaving apparatus 1000 in the manner necessary to shave a desired area of the skin. The head portion 200 is simply the distal end of the shaving apparatus 1000 and is not to be construed as necessarily a separate portion that can be removed from the shaving apparatus 1000. In some embodiments, head portion 200 includes the components necessary to cut, trim, shave, or shear the user's facial (or other) hair during use. It is noted that in some embodiments the handle portion and head portion converge into one section and that the only portion that can be separated (without the use of tools) is a disposable part such as, for example, a blade (like 211 in FIG. 5) and a blade holder. In some embodiments, the rotary cutter (like 220 in FIG. 3) is connected to, or is part of, the handle portion.

In the exemplified embodiment, the motor 130 is located within the head 200 of the shaving apparatus 1000. In FIG. 2, the motor 130 is shown schematically in a location outside of the rotary cutter 220, in other embodiments, motor 130 is located within a central cavity of the rotary cutter 220. In certain other embodiments, however, the motor 130 may be located partially or entirely within the handle 100. In certain embodiments, the rotary cutter is driven by the motor using a gear train, one or more belts, or other methods known in the art.

In the exemplified embodiment, a user-operated actuator 110, such as a switch, may be provided on the handle 100 for manually controlling the energization of the motor 130. Examples of user-operated actuators 110 include manual slide switches, capacitance touch-control, rotatable knobs, toggle switches, and combinations hereof. Any type of manual or automatic switch can be utilized as would be known by those of skill in the art. In addition to the user-operated actuator, a control circuit of controller 120 for controlling the performance characteristics of the motor 130 is also included within the chamber of the handle 100. FIG. 2 shows a controller 120 that can contain circuitry to controlling the electric motor 130 that provides the motive force to move or rotate a cutting part, such as a rotating cutter (discussed below). The controller 120 can be electric, electronic or mechanical, or any other type of controller that can provide control of the power transmitted to the electric motor 130. The controller 120 can also provide decision making for the control of other parts of the shaving apparatus such as, for example, indicator or warning lights or sound generators.

In certain embodiments, the head 200 will be detachably coupled to the handle 100 and disposable. In such embodiments, the head 200 can be sold as a "refill" head for the handle 100. The motor 130 can be located within the rotary cutter 220 of the head 200, and the power source can be located within the handle 100. A continuous electrical connection can extend from the power source in the handle 100 to the motor 130 in the head 200 in order to power the motor 130 during use. Therefore, in embodiments where the head 200 is detachably coupled to the handle 100 and the motor is located within the head 200, electrical interface connectors (i.e., contacts) can be provided at appropriate positions on both the handle 100 and the head 200 that come into electrical coupling with one another when the head 200 is coupled to the handle 100, thereby completing the electrical circuit.

Figure 3:
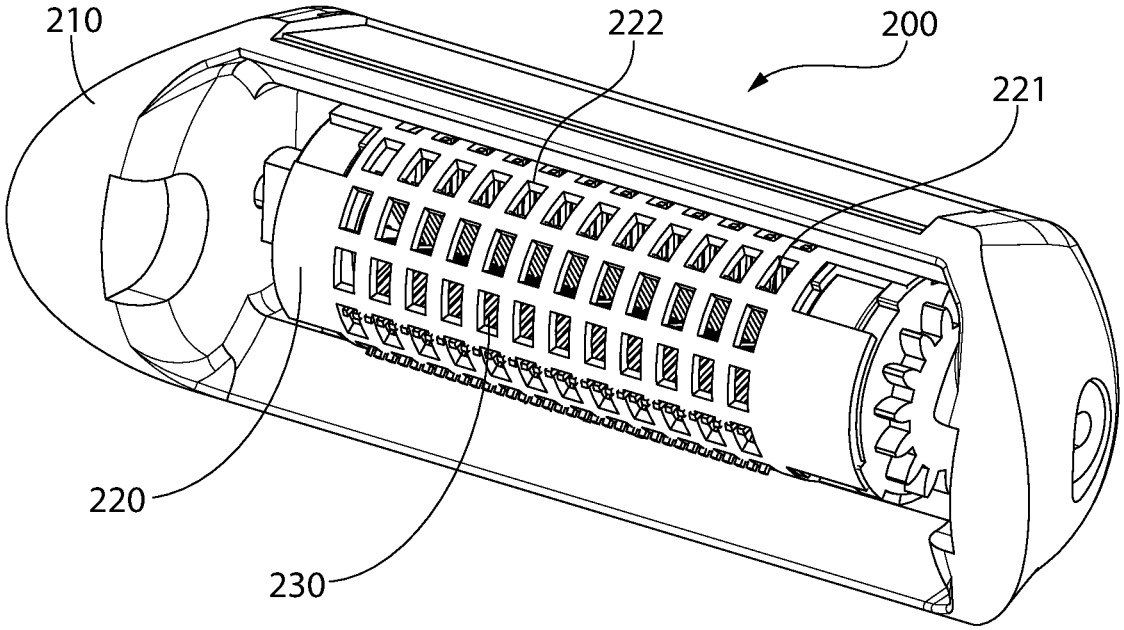
FIG. 3 is a bottom or interior perspective view of a head portion of the shaving apparatus of FIG. 1.
Figure 4:
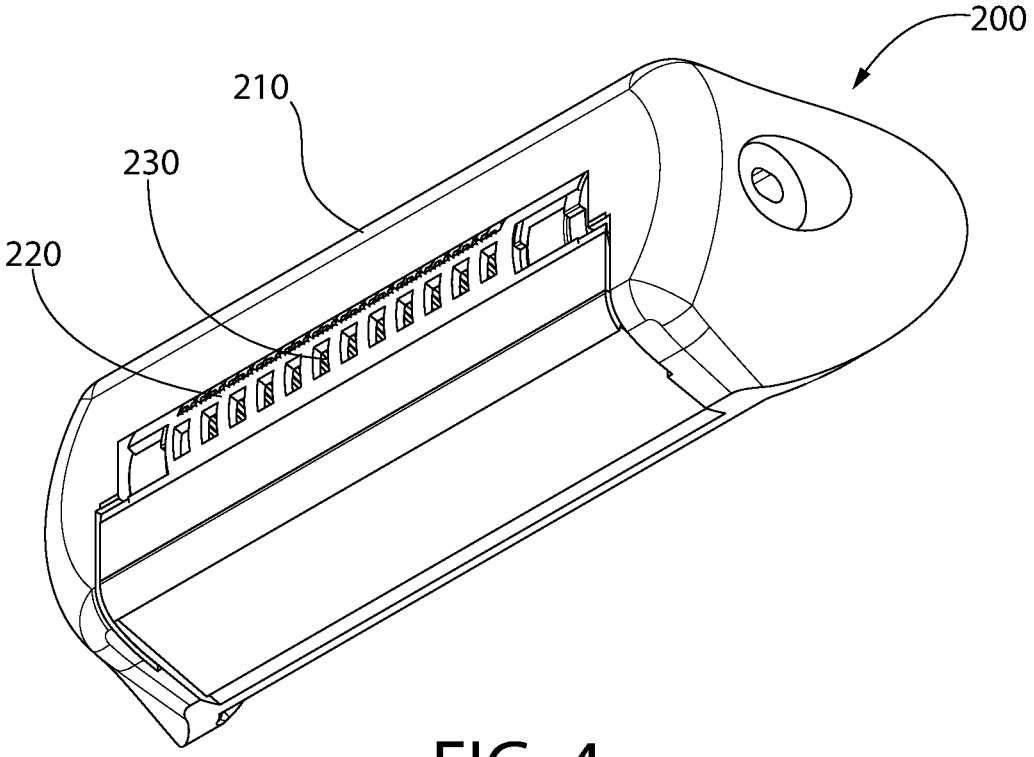
FIG. 4 is a top perspective view of the head portion of the shaving apparatus of FIG. 1.

FIG. 3 illustrates a perspective underside view of the head portion 200 of the shaving apparatus 1000 and FIG. 4 illustrates a perspective top view of the head portion 200 of the shaving apparatus 1000. The head portion 200 generally comprises a support structure 210, a rotary cutter 220, and a brush component 230. The rotary cutter 220 is positioned within an interior region of the support structure 210, and the brush component 230 is, in this example, positioned within an interior of the rotary cutter 220. The rotary cutter 220 comprises apertures 221 that are defined by a cutting edge 222 and that facilitate shearing of a user's hairs in cooperation with a blade, for example a fixed blade.

Figure 5:
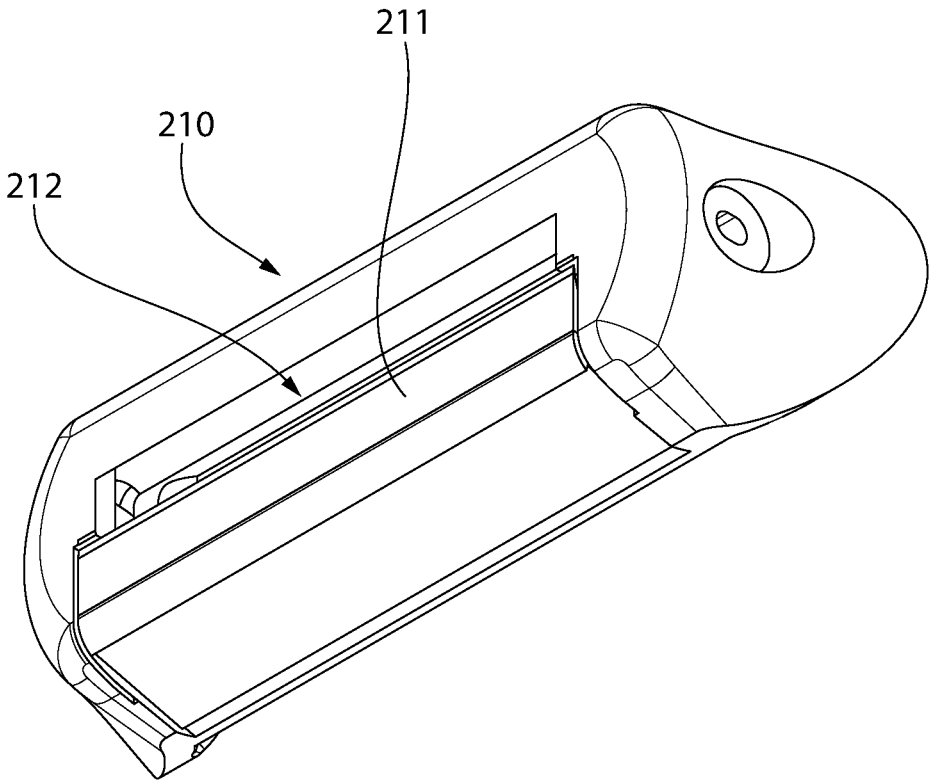
FIG. 5 is a perspective view of a support structure of the head portion of FIG. 3.

FIG. 5 illustrates a perspective top view of the support structure 210 of the head portion 200 of the shaving apparatus 1000. The fixed blade 211 is coupled to the support structure 210 (or may be formed as a part of the support structure 210 in some embodiments). The fixed blade 211 works cooperatively with the rotary cutter 220 to shear a user's hair during use. Specifically, as can be seen, the fixed blade 211 is spaced from the support structure 210 along one elongated end of the fixed blade 211, thereby forming an elongated slot 212. A user's hairs may protrude into the elongated slot 212 during use. When a user's hairs protrude into the elongated slot 212, the hairs become trapped between the cutting edges 222 of the apertures 221 of the rotary cutter 220 and the fixed blade 211 and are thereby cut.

Figure 6:
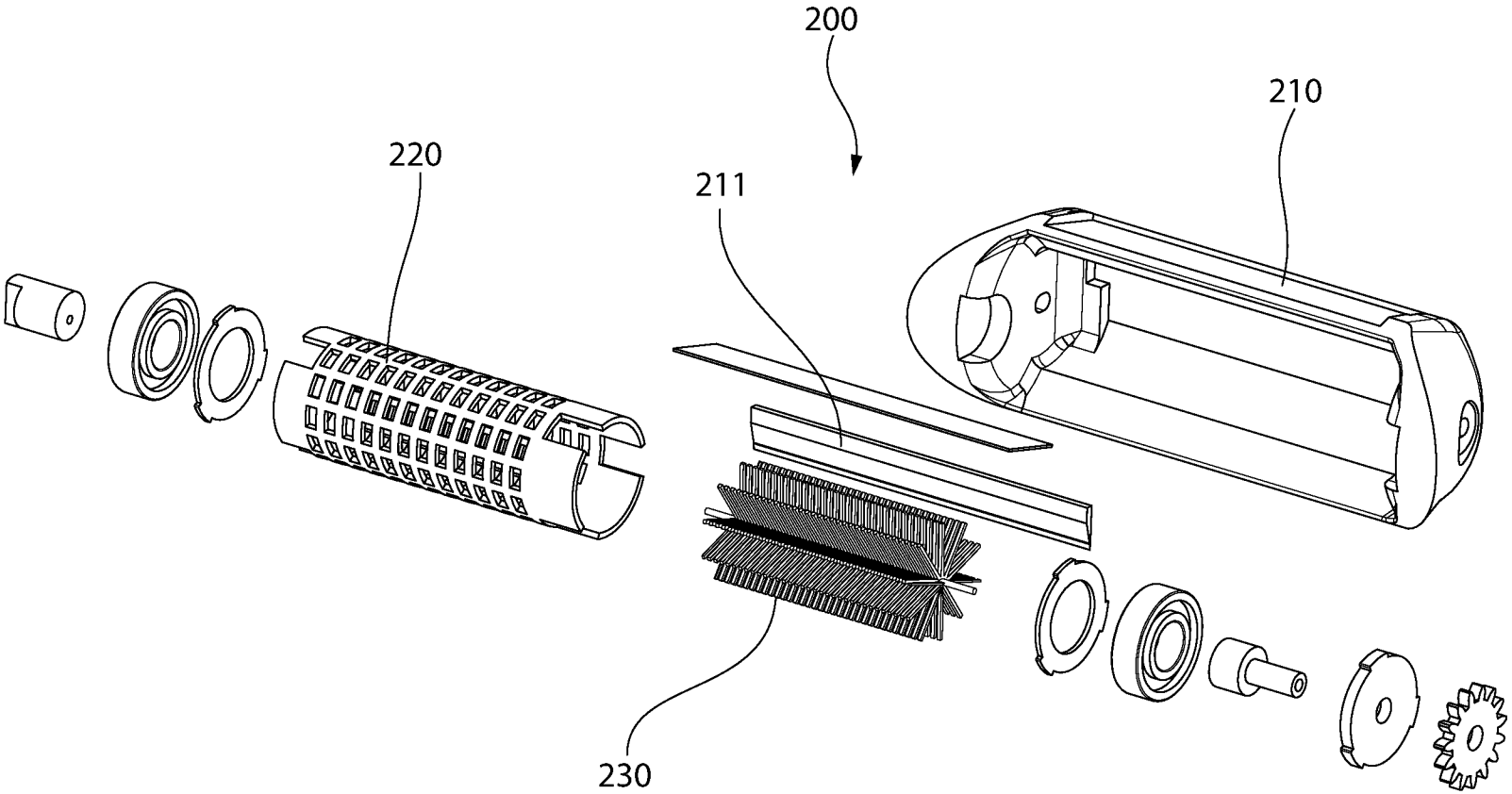
FIG. 6 is an exploded view of the head portion of FIG. 3 illustrating the support structure, a rotary cutter, and a brush component.

FIG. 6 illustrates an exploded view of the head portion 200 illustrating the support structure 210, the rotary cutter 220, and the brush component 230 as well as the fixed blade 211 and other components, such as transmission and drive components, necessary to ensure proper function and rotation of the rotary cutter 220 during use. As noted above, the brush component 230 may be inserted into the interior of the rotary cutter 220. Additional details of the brush component 230 and its relationship with the rotary cutter 220 in accordance with several alternative embodiments of the present invention will be described below.

Figure 7:
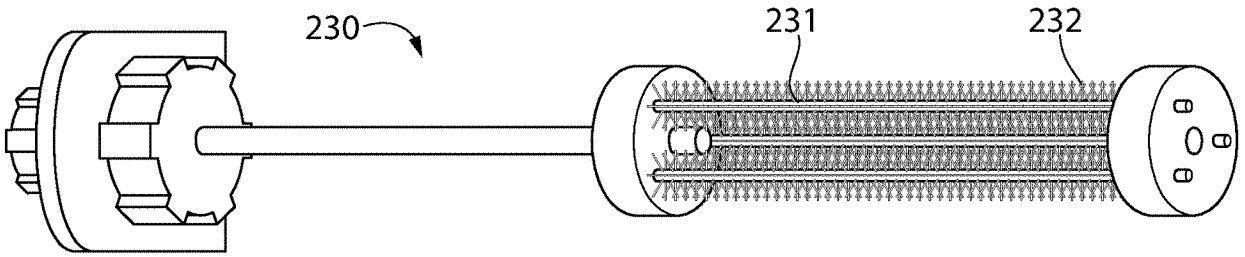
FIG. 7 illustrates a brush component in accordance with one embodiment of the present invention.

FIG. 7 illustrates one embodiment of a brush component 230. In this example, the brush component 230 comprises three base structures 231 each having a plurality of bristles 232 protruding from the base structure 231. While this example has three base structures 231, other embodiments have fewer or more base structures. The bristles 232 may be individual bristles (such as single filaments) or tufts of bristles (groups of filaments). The bristles 232 may be arranged in rows in some embodiments or may be randomly positioned along the base structure 231 in other embodiments. There may be several rows of bristles 232 extending radially from the base structure 231 as illustrated in FIG. 6. Furthermore, the bristles 232 may be formed of any desired material including without limitation plastic, nylon, thermoplastic elastomers or other elastomeric materials, or the like. The material used to form the bristles 232 may be changed to achieve a desired function.

Figure 8:
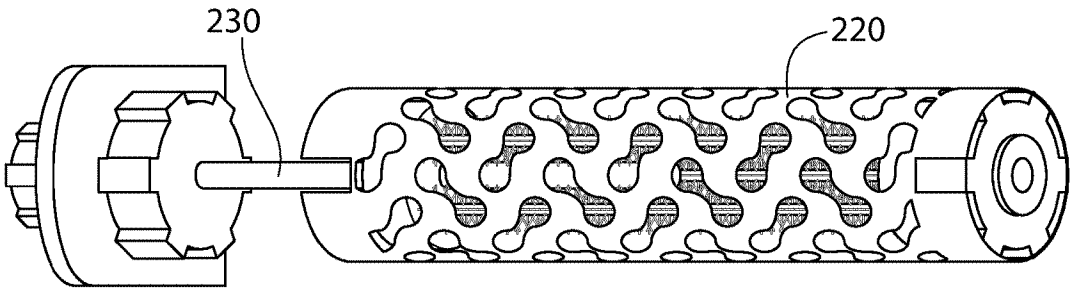
FIG. 8 illustrates the brush component of FIG. 7 partially inserted into an interior cavity of a rotary cutter.

FIG. 8 illustrates the brush component 230 of FIG. 7 inserted into the interior of the rotary cutter 220. Specifically, the rotary cutter 220 in the exemplified embodiment has an inner surface that defines a cavity or passageway. Thus, in this embodiment the rotary cutter 220 has a hollow interior rather than being a solid structure. The cavity or passageway of the rotary cutter 220 is sufficiently sized and adequately shaped to ensure that the brush component 230 may be inserted therein. In some embodiments, the brush component 230 may be inserted into the rotary cutter 220 and coupled to the rotary cutter 220 so that the brush component 230 rotates with the rotary cutter 220 as the rotary cutter 220 is rotated by the motor. The brush component 230 may rotate with the rotary cutter 220 at the same rotational speed or a different rotational speed than the rotary cutter 220.

Figure 9:
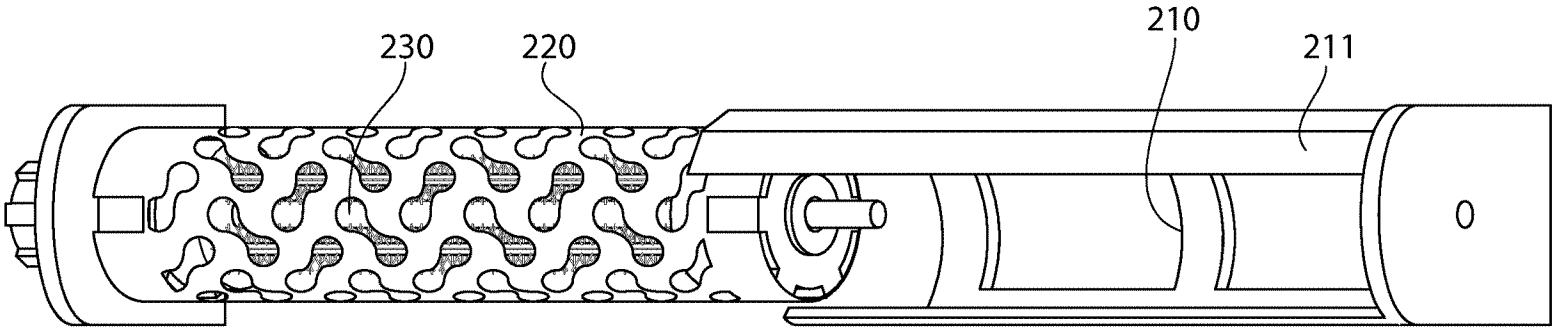
FIG. 9 illustrates the rotary cutter with the brush component inserted therein positioned adjacent to a support structure.
Figure 10:
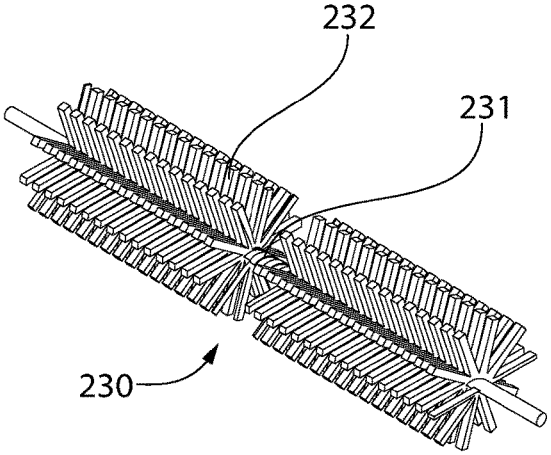
FIG. 10 is a perspective view of a brush component in accordance with an embodiment of the present invention.
Figure 11:
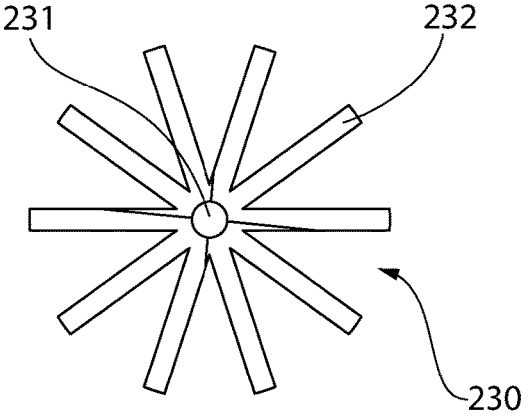
FIG. 11 is a side view of the brush component of FIG. 10.
Figure 12:
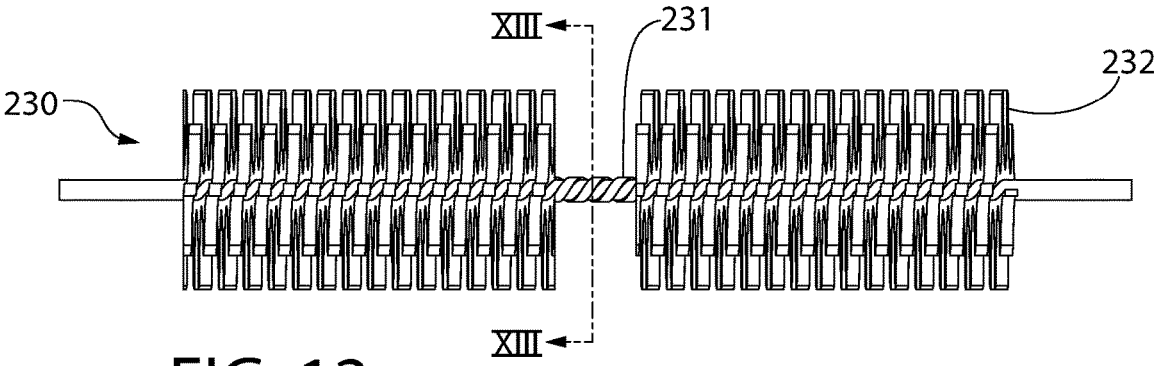
FIG. 12 is a front view of the brush component of FIG. 10.
Figure 13:
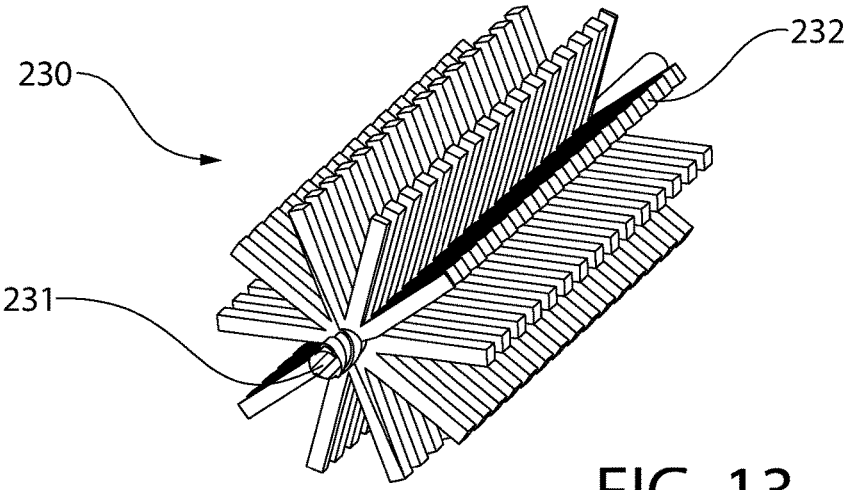
FIG. 13 is a cross-sectional perspective view taken along line XIII-XIII in FIG. 12.

FIG. 9 illustrates the brush component 230 fully positioned within the interior of the rotary cutter 220 and adjacent to the support structure 210. In the fully assembled head portion 200, the rotary cutter 220 with the brush component 230 therein is inserted into and operably coupled to the support structure 210 so that the cutting edges 222 of the rotary cutter 220 may cooperate with the fixed blade 211 of the support structure 210 to ensure sufficient shearing of a user's hairs during use. Specifically, as the rotary cutter 220 is rotated, the user's hairs are cut by the cutting edges 222 of the apertures 221 and/or the fixed blade 211.

FIGS. 10-13 illustrate different views of one embodiment of the brush component 230. In FIGS. 10-13, the bristles 232 of the brush component 230 extend radially from the base structure 231 of the brush component 230 in rows. In this example, the brush component 230 is created by twisting a wire, or several wires, as the base structure 231 to capture the bristles 232. In FIGS. 10-13, the bristles 232 are shown as having the same length. In other embodiments, the bristles 232 can have different lengths. Other arrangements for the bristles 232 are possible in other embodiments.

Figure 14:
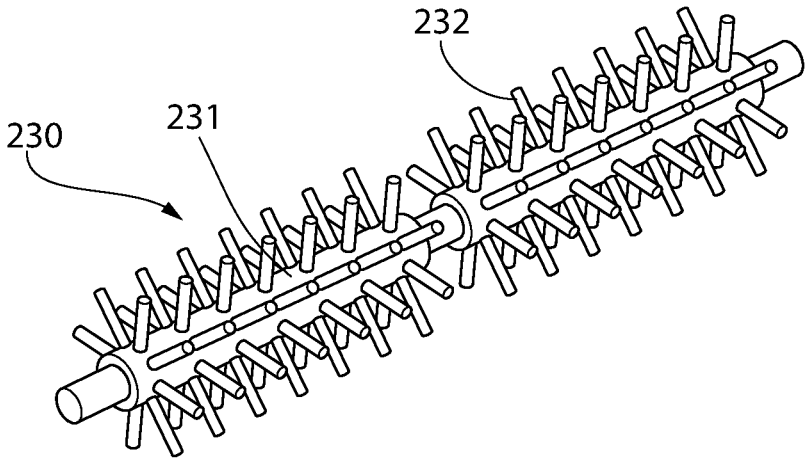
FIG. 14 is a perspective view of a brush component in accordance with another embodiment of the present invention.

FIG. 14 illustrates another embodiment of the brush component 230. The brush component 230 in FIG. 14 has a plurality of thick bristles 232 extending from the base structure 231. The bristles 232 of the embodiment shown in FIG. 14 are thicker than those in other embodiments and fewer in number. This embodiment can provide better results than smaller bristles with certain types of hair or whiskers. The bristles 232 in FIG. 14 can be made more rigid or less rigid than bristles in other embodiments.

Figure 15:
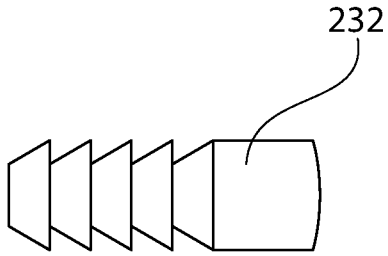
FIG. 15 is a close-up view of one of the bristles of the brush component of FIG. 14.

FIG. 15 illustrates a close-up view of one example of the bristles 232 of the brush component 230. In this example, the bristle 232 has a barbed structure that can facilitate grabbing the hair or whisker to make the hair or whisker stand up.

Figure 16:
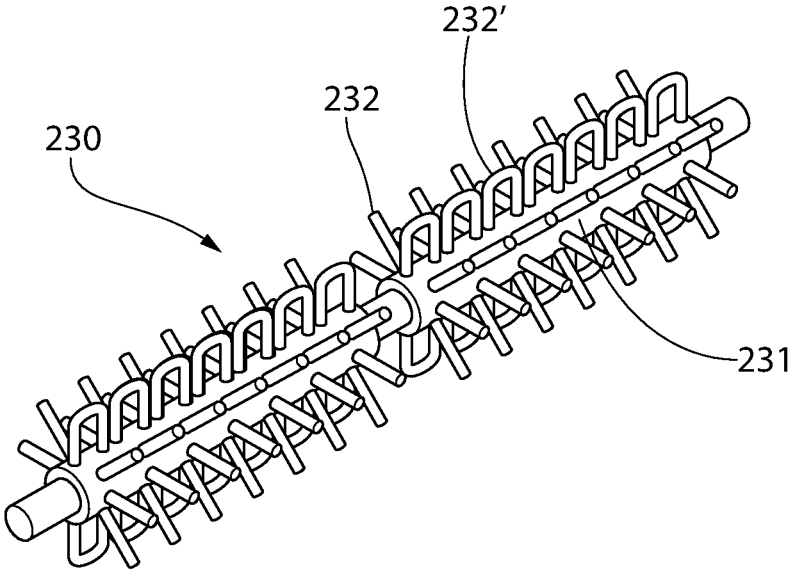
FIG. 16 is a perspective view of a brush component in accordance with another embodiment of the present invention.

FIG. 16 illustrates yet another embodiment of the brush component 230 that includes filaments 232 extending outwardly from the base structure 231 and filaments 232' that are bent into a U-shape with the bent portion of the bristles 232' furthest from the base structure 231. In this example, the filaments 232' are positioned with the curved sections at the most distal position from the base structure 231. Other embodiments can position the U-shaped filaments 232' with their curved sections proximate the base structure 231. Other embodiments can use a closed loop shape, a hook shape, or any other shape that can perform the function described above.

It is noted that the embodiments of the brush component illustrated in FIGS. 6-16 are merely exemplary in nature and are not intended to be limiting of the invention in all embodiments. Thus, the brush component 230, and the bristles 232 (also referred to herein as brush whiskers) thereof, may take on other shapes, appearance, and structures. The bristles 232 may include grooves, protrusions, flanges, different textures, or the like to achieve a desired function or to enhance their function. One function of the bristles may be to pull the user's hairs upwardly away from the user's face to ensure an effective and consistent shearing of the hairs. Another function of the bristles may be to block the user's skin from entering into the apertures 221 of the rotary cutter 220 and being cut.

In certain embodiments, the brush component 230 is positioned within the rotary cutter 220 and rotates with it. In one embodiment, the brush component 230 rotates at the same speed/velocity as the rotary cutter 220. In another embodiment, the brush component 230 rotates at a faster velocity than the rotary cutter 220. In still another embodiment, the brush component rotates at a slower velocity than the rotary cutter 220. In some embodiments, some of the bristles 232 of the brush component 230 protrude out of some of the apertures openings 221 of the rotary cutter 220 (as described below with reference to FIGS. 18-23). In other embodiments, some of the bristles 232 of the brush component 230 are approximately flush with the rotary cutter 220 external surface (as described below with reference to FIG. 17). In one embodiment, some of the bristles 232 of the brush component 230 are contained within the aperture 221 thickness, that is, within the aperture 221 walls, but do not protrude out of the apertures 221 external openings. These variations and more will be described with reference to FIGS. 17-24 below.

Figure 17:
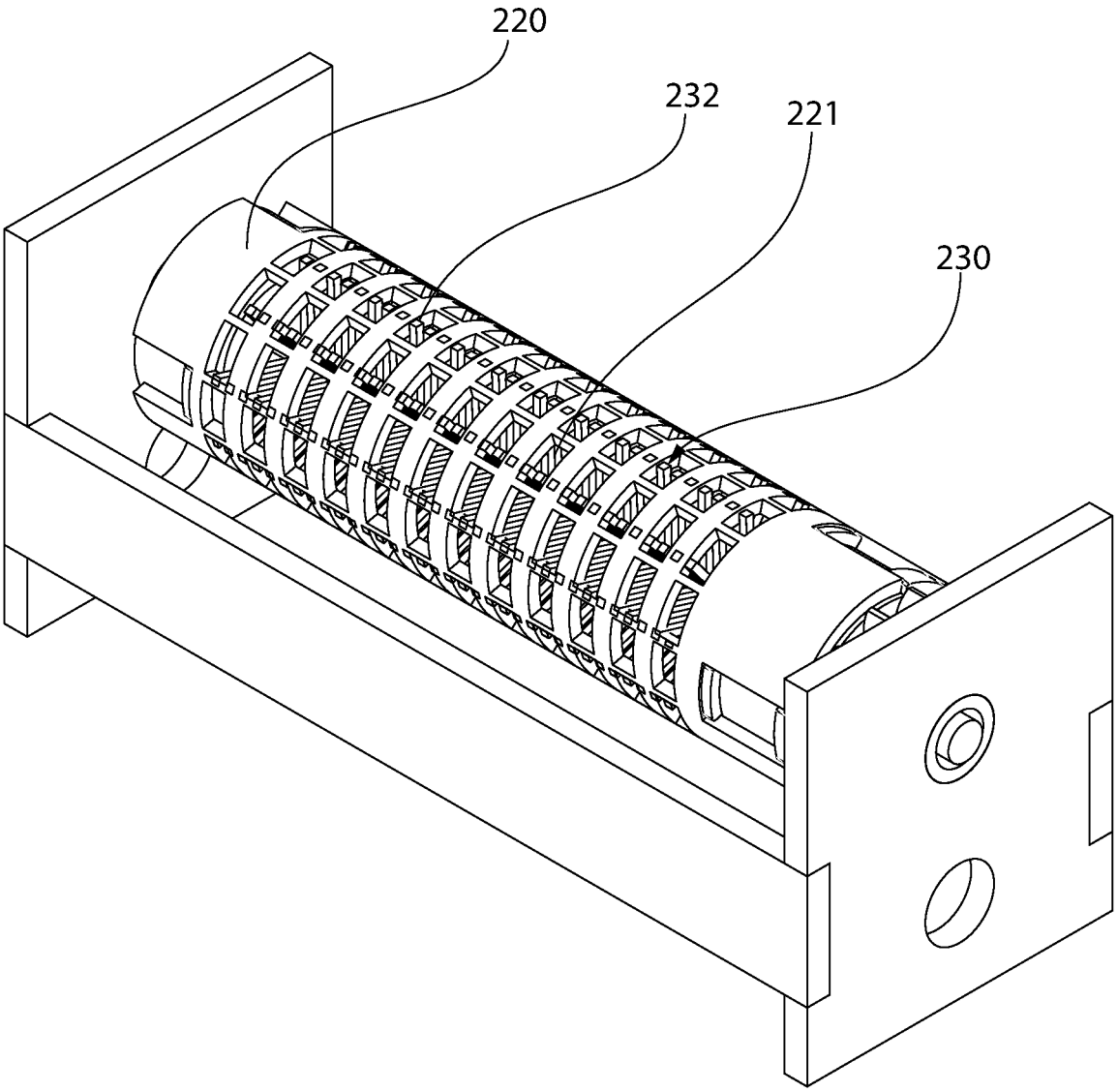
FIG. 17 is a perspective view of a head portion of a shaving apparatus in accordance with another embodiment of the present invention.

FIG. 17 shows one embodiment of the invention wherein the brush component 230 is positioned within the interior cavity or passageway of the rotary cutter 220. The brush component 230, and more specifically the bristles 232 thereof, lifts and "guides" whiskers (i.e., a user's hair such as facial hair or the like) towards the aperture openings 221 and towards the shearing line (the shearing line being the location at which the aperture openings 221 cooperate with the fixed blade 211 to shear the whiskers). For example, consider facial whiskers that are laying down, whose direction is closer to parallel to the skin as opposed to perpendicular to the skin. The bristles 232 of the brush component 230 can lift and or move these facial whiskers, such that they enter the aperture opening 221 and reach the shearing line. Similarly, consider a portion of the face or neck, wherein the facial whiskers hair growth pattern is mixed. The bristles 232 of the brush component 230 can lift and or move these facial whiskers, such that they enter the aperture opening 221 and reach the shearing line.

When the rotary cutter 220 is pressed against the skin, the skin might bulge slightly into the aperture openings 221. In an extreme case with some shavers, the skin may be cut. With the bristles 232 of the brush component 230 protruding into and contained within (and possibly also protruding out of) the aperture openings 221, the aperture openings 221 are effectively "open" for facial whiskers to get in, but closed to the skin to bulge in the aperture openings 221. Thus, the bristles 232 of the brush component 230 decrease the amount of skin that can bulge into the aperture openings 221 and thereby reduces the opportunity for the skin to be cut.

In the embodiment of FIG. 17, the bristles 232 of the brush component 230 extend into the apertures 221 of the rotary cutter 220, but do not protrude beyond an outer surface of the rotary cutter 220 at any point. Specifically, in this embodiment the rotational axis of the brush component 230 is the same as (coincident with) the rotational axis of the rotary cutter 220. Furthermore, the lengths of the bristles 232 are substantially the same. Thus, in this embodiment the bristles 232 of the brush component 230 extend through the apertures 221 of the rotary cutter 220 substantially to the outer surface of the rotary cutter 220 without protruding beyond the outer surface of the rotary cutter 220. If the bristles 232 were to extend beyond the outer surface of the rotary cutter 220 in this embodiment, they could be sheared between the rotary cutter 220 and the fixed blade 211. Although this embodiment is illustrated with all bristles 232 being the same length, the invention is not to be so limited and the bristles 232 may have varying lengths while still ensuring that none of the bristles 232 extend to a position beyond the outer surface of the rotary cutter 220. In this embodiment, when a user's whiskers enter into the apertures 221, the bristles 232 may contact the user's whiskers and cause the user's whiskers to stand upright (rather than lying down as described above), which will ensure that the whiskers are more effectively, efficiently, accurately, and consistently cut by the shaving apparatus.

Figure 18:
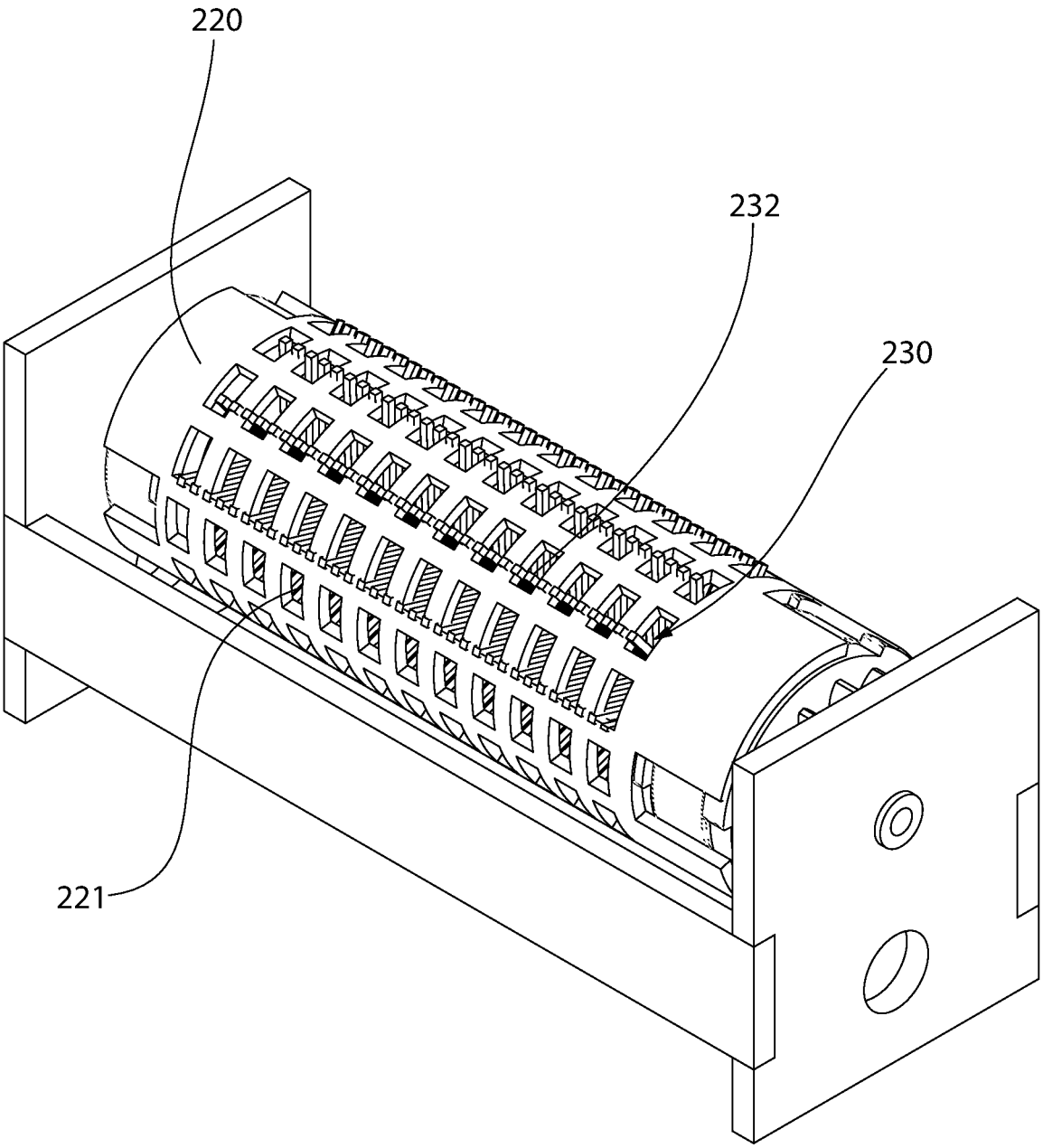
FIG. 18 is a perspective view of a head portion of a shaving apparatus in accordance with yet another embodiment of the present invention.
Figure 19:
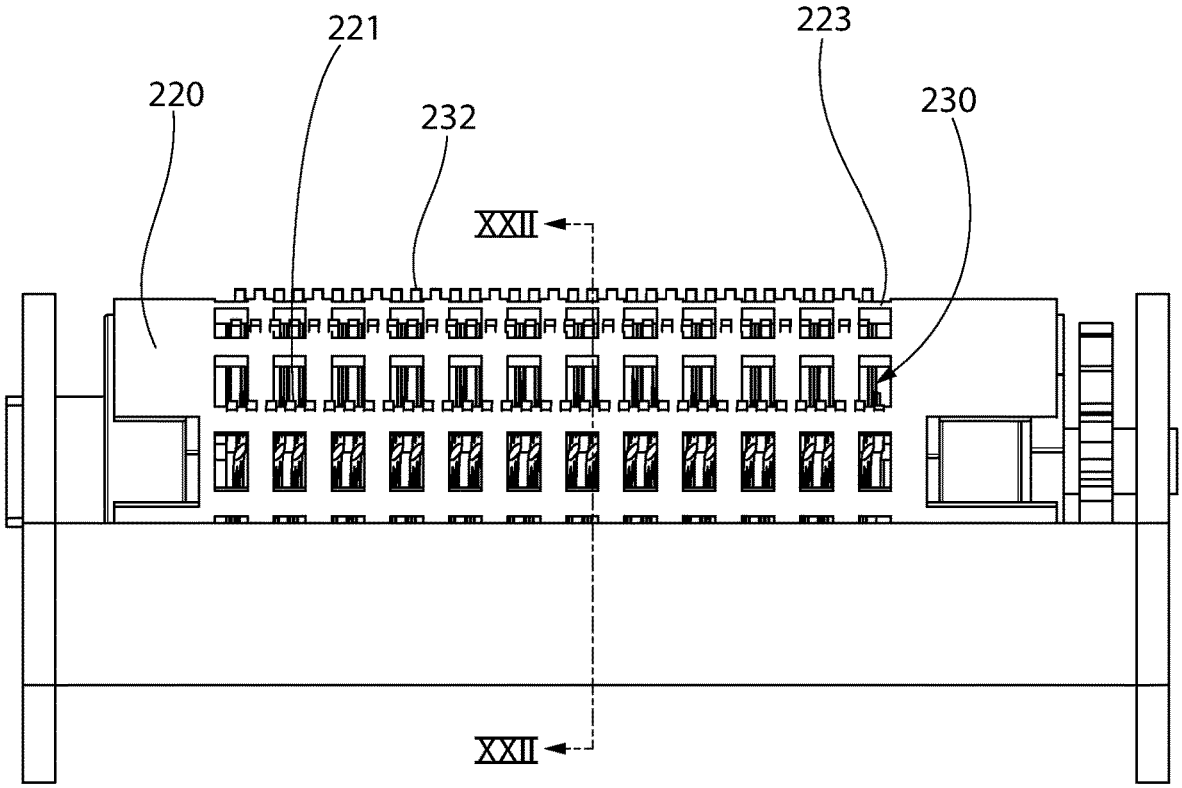
FIG. 19 is a front view of the head portion of FIG. 18.
Figure 20:
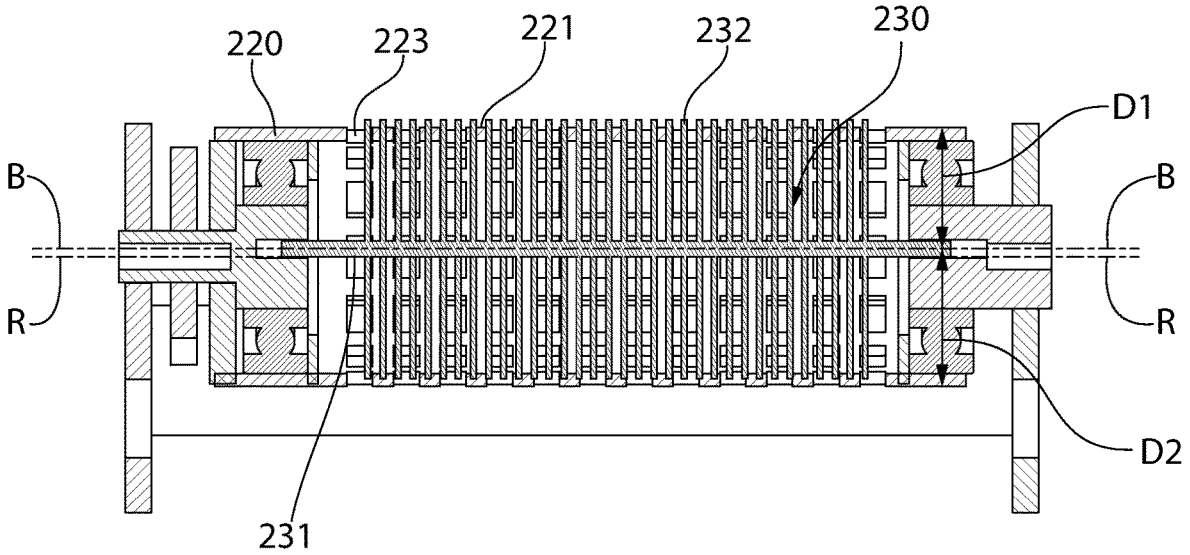
FIG. 20 is a longitudinal cross-sectional view of the head portion of FIG. 19.

FIGS. 18-20 illustrate an alternative embodiment that is similar to the embodiment shown in FIG. 17 except that the bristles 232 protrude out of the apertures 221 in the rotary cutter 220 beyond the outer surface 223 of the rotary cutter 220 in some circumferential locations. In this embodiment, the bristles 232 protrude out of the apertures 221 at different lengths based on the rotational position of the brush component 230. In the exemplified embodiment, this is achieved as follows (referring particularly to FIG. 20). The bristles 232 all have the same length of extension as measured from the base portion 231 of the brush component 230 to a distal tip of the bristles 232. However, the brush component 230 has a rotational axis B-B that is offset from the rotational axis R-R of the rotary cutter 220. Thus, a distance D1 between the rotational axis B-B of the brush component 230 and the outer surface 223 of the rotary cutter 220 at a first circumferential location is less than a distance D2 between the rotational axis B-B of the brush component 230 and the outer surface 223 of the rotary cutter 220 at a second circumferential location. The length of the bristles 232 is greater than the first distance D1 and less than (or equal to) the second distance D2. Thus, when the bristles 232 are positioned at the first circumferential location (top of the Figure), the bristles 232 will protrude through the apertures 221 in the rotary cutter 220 and extend beyond the outer surface 223 of the rotary cutter 220. When the bristles 232 are positioned at the second circumferential location (bottom of the Figure), the bristles 232 will not protrude through the apertures 221 (or at least will not extend beyond the outer surface 223 of the rotary cutter 220).

Figure 21:
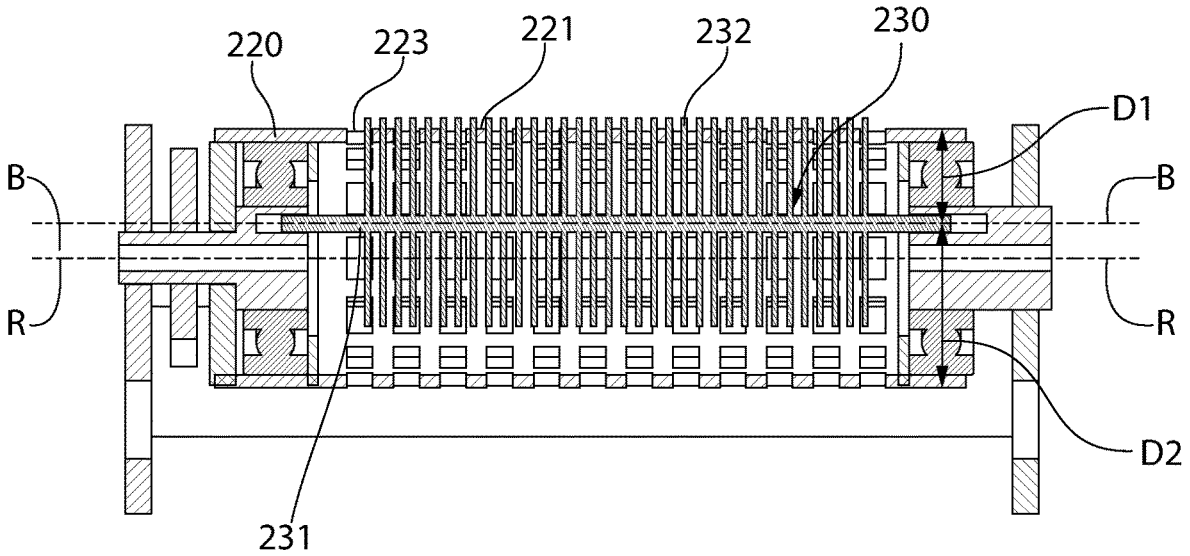
FIG. 21 is an alternative embodiment to FIG. 20.

FIG. 21 illustrates one alternative embodiment wherein the offset distance between the rotational axes R-R, B-B is increased. The embodiment of FIGS. 18-20 may be used when the diameter of the brush component 230 is the same as the diameter of the rotary cutter 220 because in that instance only a very slight offset distance is required to ensure that the bristles 232 protrude beyond the outer surface 223 of the rotary cutter 220. The embodiment of FIG. 21 may be used when the diameter of the brush component 230 (measured from bristle tip to bristle tip) is less than the diameter of the rotary cutter 220 because in that instance a greater offset distance is required to ensure that the bristles 232 protrude beyond the outer surface 223 of the rotary cutter 220 at the first circumferential location (top of the Figure).

Figure 22:
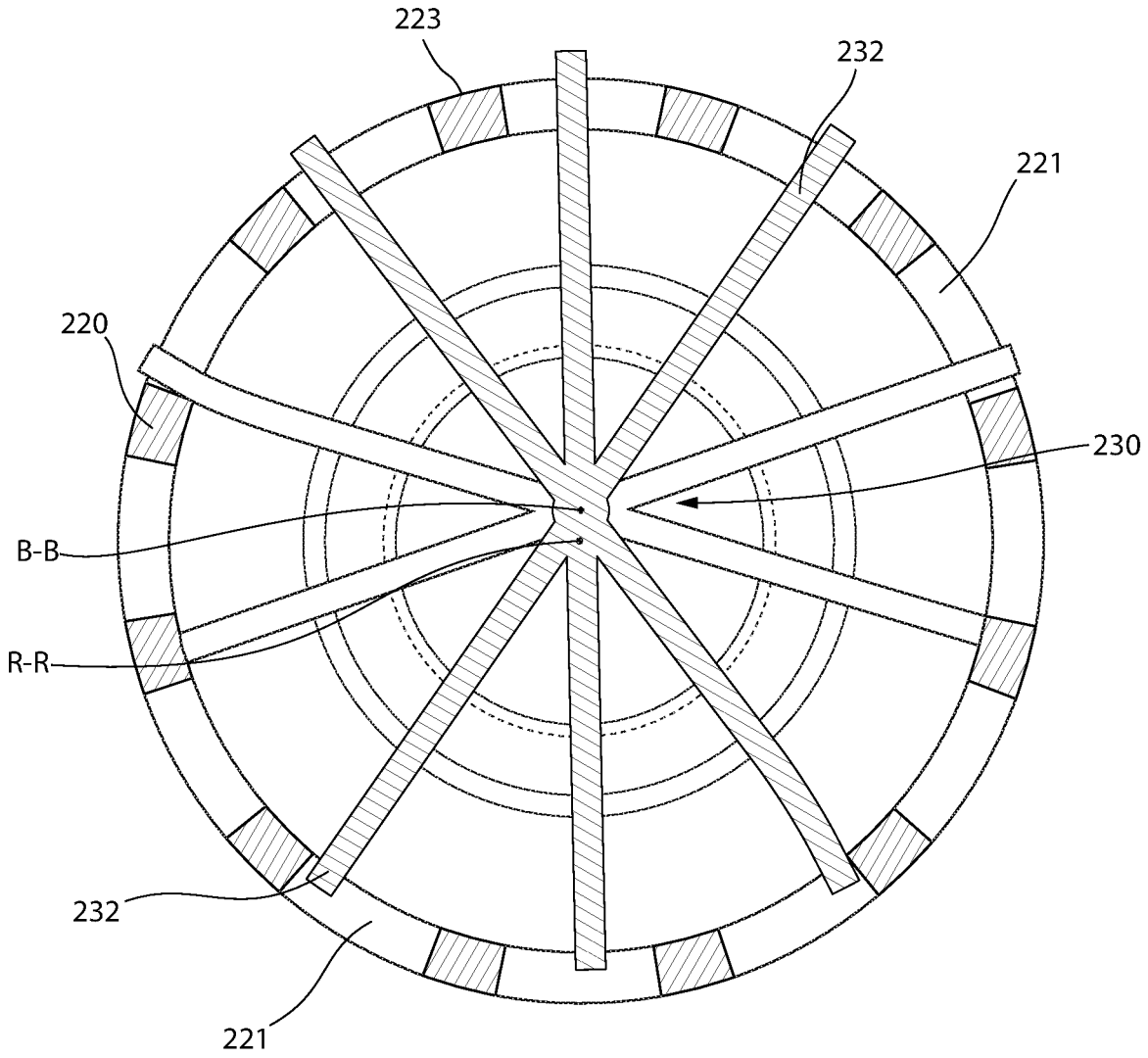
FIG. 22 is a transverse cross-sectional view taken along line XXII-XXII in FIG. 19.

FIG. 22, which is representative of the embodiment of FIGS. 18-20, illustrates a transverse cross-sectional view through the assembled rotary cutter 220 and brush component 230 (i.e., with the brush component 230 positioned in the internal cavity of the rotary cutter 220). As can be seen, some of the bristles 232 of the brush component 230 protrude through the apertures 221 in the rotary cutter 220 and extend beyond the outer surface 223 of the rotary cutter 220 (at the top of the Figure) whereas others of the bristles 232 of the brush component 230 do not protrude through the apertures 221 in the rotary cutter 220 and do not extend beyond the outer surface 223 of the rotary cutter 220 (at the bottom of the Figure). As noted above, this is achieved in the exemplified embodiment by offsetting the rotational axes R-R, B-B of the rotary cutter 220 and the brush component 230, respectively. However, there are other techniques that may be used to achieve this same effect as would be appreciated by persons skilled in the art. In the exemplified embodiment, the bristles 232 protrude beyond the outer surface 223 of the rotary cutter 220 within a portion of the elongated slot 212, but then do not extend beyond the outer surface 223 of the rotary cutter 220 as the bristles 232 become aligned with the fixed blade 211. Thus, the bristles 232 are able to perform the functions described herein (pulling up the user's hair for more effective and consistent shearing) while also ensuring that the bristles 232 do not become sheared by the fixed blade 211 and the rotary cutter 220 (except possibly during an initial preparation procedure of a new brush).

Figure 23:
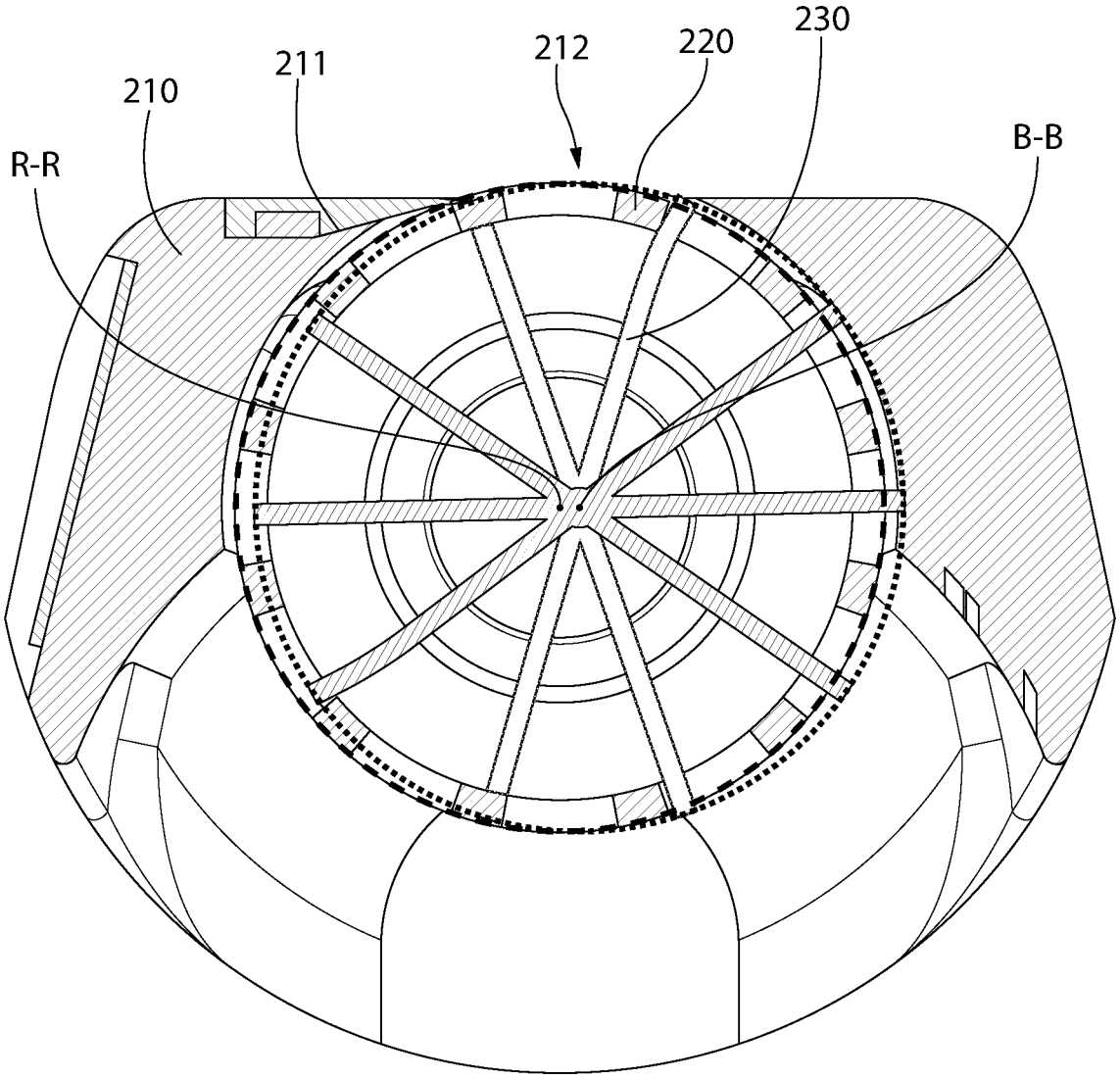
FIG. 23 is a transverse cross-sectional view of the head portion of FIG. 3.

FIG. 23 illustrates a transverse cross-section of the brush component 230 and rotary cutter 220 of FIG. 22 coupled to the support structure 210. A reference diameter for the brush component 230 measured about the distal tips of the bristles 232 is illustrated as a dotted-line circle. A reference diameter for the outer surface 223 of the rotary cutter 220 is illustrated as a dashed-line circle. As can be seen, the reference diameter of the brush component 230 is offset relative to the reference diameter of the rotary cutter 220. As a result, the bristles 232 protrude beyond the outer surface 223 of the rotary cutter 220 at some locations (at the right side of the Figure), but not others (at the left side of the Figure). In the exemplified embodiment, the bristles 232 protrude beyond the outer surface 223 of the rotary cutter 220 within a portion of the elongated slot 212, but then do not extend beyond the outer surface 223 of the rotary cutter 220 as the bristles 232 become aligned with the fixed blade 211. Thus, the bristles 232 are able to perform the functions described herein (pulling up the user's hair for more effective and consistent shearing) while also ensuring that the bristles 232 do not become sheared by the fixed blade 211 and the rotary cutter 220.

Figure 24:
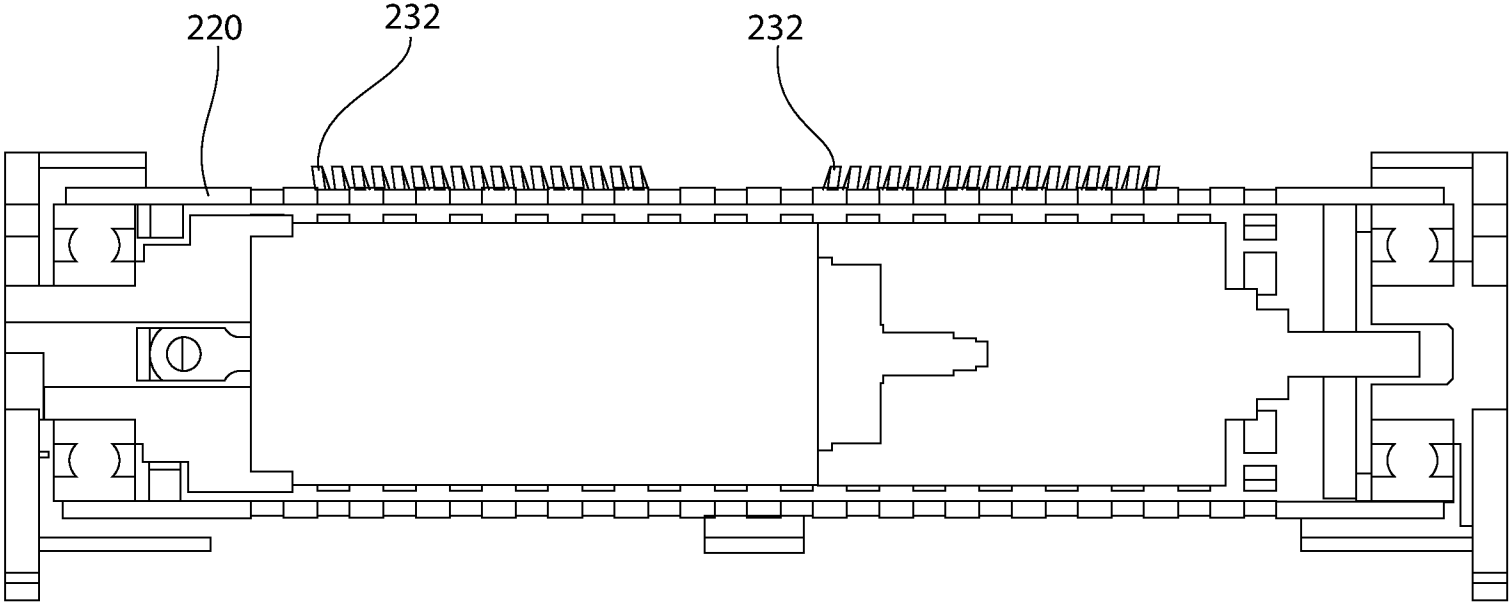
FIG. 24 is a schematic longitudinal cross-sectional view of a head portion of a shaving apparatus in accordance with another embodiment of the present invention.

FIG. 24 illustrates an alternative embodiment/arrangement in which bristles 232, which may be stand-alone or a part of a larger brush component, are embedded in the rotary cutter tube 220. Thus, in this embodiment the brush component is not positioned within the internal cavity of the rotary cutter, but rather the brush component merely comprises bristles coupled to the outer surface of the rotary cutter or otherwise securely coupled to the rotary cutter as illustrated.

In a particular embodiment, the bristles 232 closer to the fixed blade 211 are slightly longer than the bristles 232 closer to the shearing portions of the aperture 221. Consider a brush component, whose overall diameter is slightly larger than the diameter of the rotary cutter and its brush whiskers are approximately the same length. Some of the brush whiskers will protrude out of some of the aperture openings. Further consider that the rotary cutter, with the brush inside is rotated such that the shearing system with the fixed blade is enabled. During an initial use, some of the brush whiskers protruding out of aperture openings will be sheared. However, shearing takes place only along portions of the aperture that are further away from the fixed blade. Specifically, in the exemplified embodiment the apertures are square or rectangular-shaped. As the rotary cutter is rotated, the edge of the aperture that reaches the fixed blade first is the portion of the aperture that is further away from the shearing portions of the aperture and the edge of the aperture that reaches the fixed blade later is the portion of the aperture that is closer to the shearing portion of the aperture and that is actively engaged in the shearing function. The brush whiskers close to the shearing portions of the aperture will be sheared approximately flush with the rotary cutter external surface. The brush whiskers further away from the shearing portions of the aperture will be bent by the force applied on them by the fixed blade, until they reach the shearing portions of the aperture, where they will be sheared. However, when they pass the fixed blade and straighten out, their length will be such that they protrude above the rotary cutter external surface. Hence, in some embodiments brush whiskers located near the shearing portions of the aperture will be shorter than brush whiskers located further away from the shearing portions of the aperture.

In an embodiment, a brush whose overall diameter is approximately equal to or greater than the rotary cutter diameter is inserted into the rotary cutter. In an embodiment, a brush holder that supports at least one brush, whose overall diameter is smaller than the rotary cutter diameter, is inserted into the rotary cutter. In an embodiment, a brush holder that supports multiple brushes, e.g. 2, 3, 4, 5, 10, whose overall diameter is smaller than the rotary cutter diameter is inserted into the rotary cutter. In an embodiment, the brush and/or brush holder axis of rotation coincides, or approximately coincides, with the rotary cutter axis of rotation. In an embodiment, the brush holder axis of rotation is offset relative to the rotary cutter axis of rotation.

In an embodiment, a brush or brush holder with at least one brush, whose overall diameter is approximately equal or smaller than the rotary cutter diameter is inserted into the rotary cutter. In an embodiment, the brush and/or brush holder axis of rotation is approximately parallel but does not coincide with the rotatory cutter axis of rotation. Such a system will cause the bristles (also referred to herein as brush whiskers) to move radially within the aperture opening, such that whiskers will protrude out of some apertures and not out of other apertures. For example, consider a system wherein the whiskers move inward, radially, as they approach the fixed blade shearing line, and move outward, radially, as they rotate away from the fixed blade.

As discussed above, portions of the rotary cutter apertures function as one member of the dual member shearing system that shears the whiskers. For the shearing to occur, a portion of the whisker must enter the aperture. In an embodiment, the portion of the whisker enters the aperture to a depth of the entire thickness of the aperture. That is, if the rotary cutter tube thickness is 0.5 mm, at least 0.5 mm of the whiskers length will enter the aperture. In an embodiment, a portion of the whisker enters the aperture at a depth of only a portion of the thickness of the aperture.

The rotary cutter aperture shape is designed to support the whisker during the shearing process. A supported whisker will be less likely to move as it is being sheared. A supported whisker will more likely have a flat cut end. In an embodiment, the rotary cutter aperture includes features that are on the order of the hair diameter. In an embodiment, the rotary cutter aperture includes serrated edges.

Figure 25:
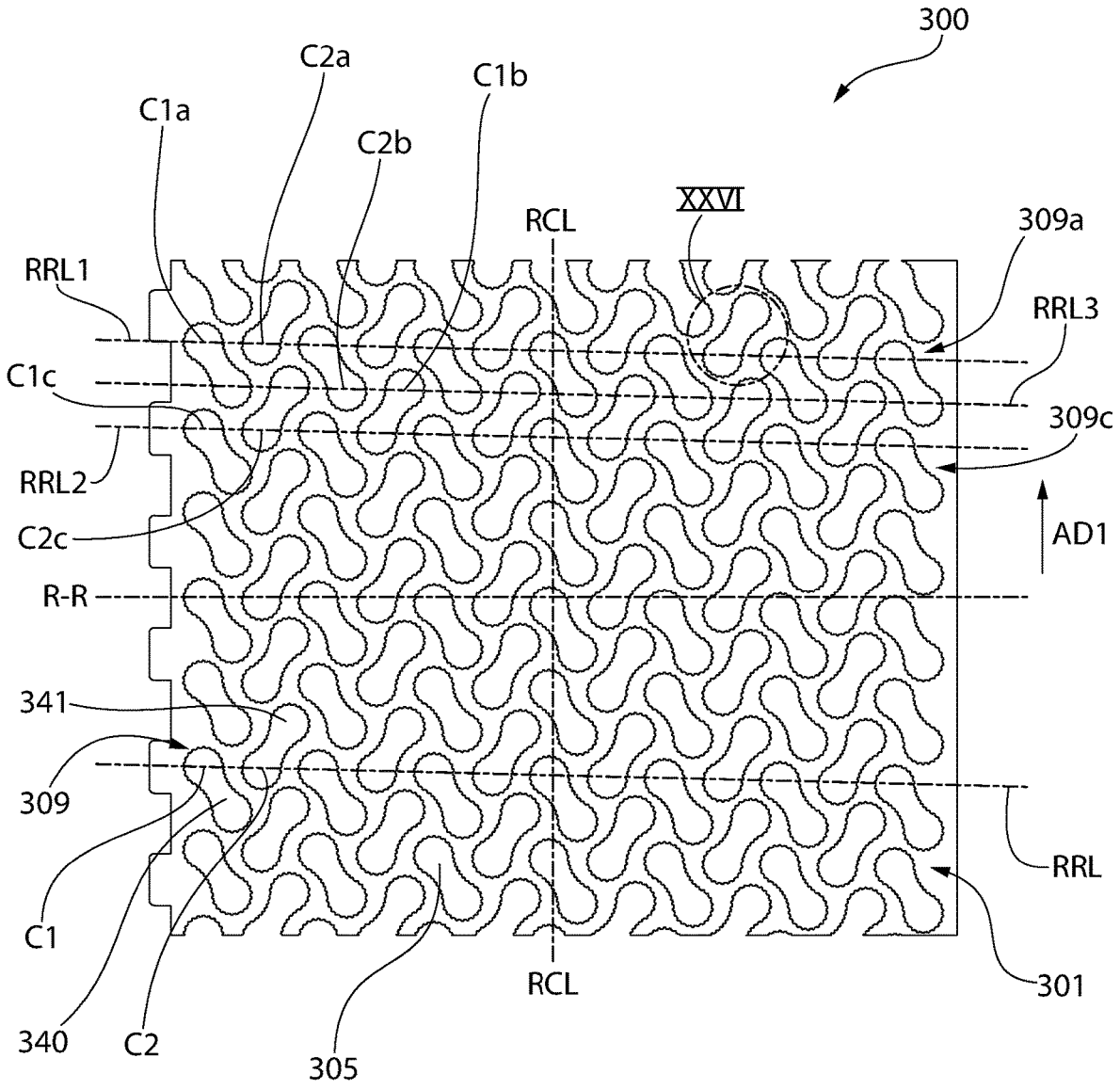
FIG. 25 is a two-dimensional plan view of an exemplary rotary cutter having a pattern of apertures that can be used with the shaving apparatus of the present invention.
Figure 26:
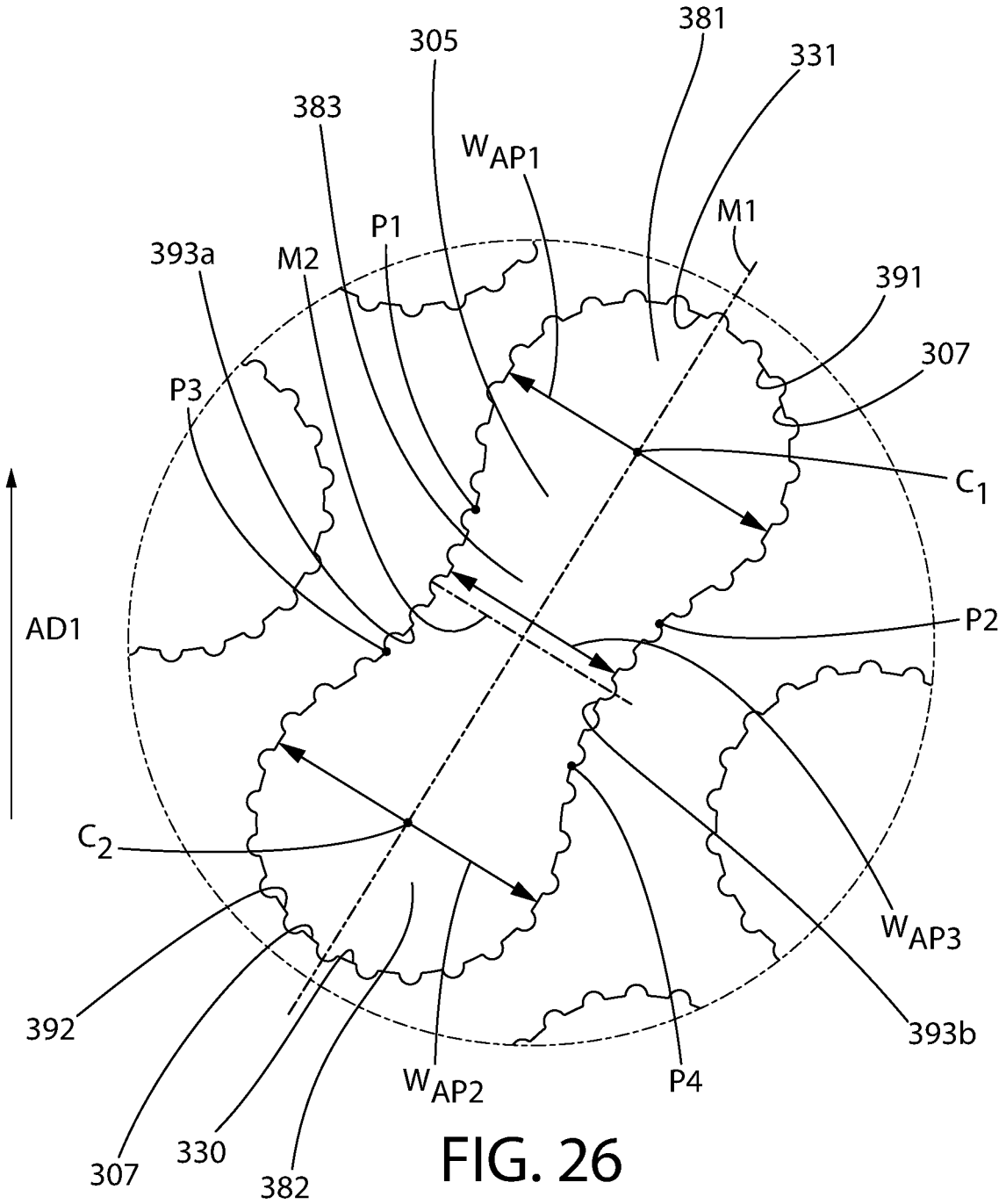
FIG. 26 is a close-up view of area XXVI of FIG. 25.

Referring now to FIGS. 25 and 26 concurrently, a rotary cutter 300 is exemplified that comprises a cutter tube 301 including apertures 305 having a peanut shape, as discussed further herein. In the exemplified embodiment, each of the apertures 305 comprises a major axis M1 and a minor axis M2 wherein M1 is longer than M2. Each of the apertures 305 is defined by a cutting edge 307 that defines a closed-geometry. It is noted that FIGS. 25 and 26 show the cutter tube 301 in a flattened view for clarity in association with this discussion.

The apertures 305 comprises at least three portions including a first aperture portion 381, a second aperture portion 382, and a neck aperture portion 383. The first aperture portion 381 may be connected to the second aperture portion 382 by the neck aperture portion 383. The major axis M1 may extend between the first aperture portion 381 and the second aperture portion 382 and through the neck aperture portion 383.

The first aperture portion 381 may be defined by a first cutting edge portion 391 having a first geometry. The first cutting edge portion 391 forms a part of the cutting edge 307. Non-limiting examples of the first geometry include portions of a circle, oval, or polygon. In the exemplified embodiment, the first geometry is a portion of a circle. The second aperture portion 382 may be defined by a second cutting edge portion 392 that has a second geometry. The second cutting edge portion 392 forms a part of the cutting edge 307. Non-limiting examples of the second geometry include portions of a circle, oval, or polygon. In the exemplified embodiment, the second geometry of the second cutting edge portion 391 is a portion of a circle. The first and second geometry may be the same or different.

The first geometry is an open geometry such that the first cutting edge portion 391 extends between a first point P1 and a second point P2 along the cutting edge 307—whereby the first point P1 and the second point P2 do not coexist. The second geometry is also an open geometry such that the second cutting edge portion 392 extends between a third point P3 and a fourth point P4 along the cutting edge 307—whereby the third point P3 and the fourth point P4 do not coexist.

The neck aperture portion 383 may be defined as the space between two opposite portions of the cutting edge 307—the opposite portions including a first neck wall 393*a* that extends between the first point P1 and the third point P3 of the cutting edge 307, and a second neck wall 393*b* that extends between the second point P2 and the fourth point P4 of the cutting edge 307. Together, the first cutting edge portion 391, the second cutting edge portion 392, the first neck wall 393*a*, and the second neck wall 393*b* may form the entirety of the closed geometry of the cutting edge 307.

The first aperture portion 381 may have a first aperture portion width $W_{AP1}$ that is the maximum distance between opposite sides of the first cutting edge portion 391. When the first geometry is circular and the center point of the circle overlaps with the major axis M1, the first aperture portion width $W_{AP1}$ may be measured in a direction that is normal to the major axis M1. The second aperture portion 382 may have a second aperture portion width $W_{AP2}$ that is the maximum distance between opposite sides of the second cutting edge portions 392. When the second geometry is circular and the center point of the circle overlaps with the major axis M1, the second aperture portion width $W_{AP2}$ may be measured in a direction that is normal to the major axis M1. The neck portion 383 may have a third aperture portion width $W_{AP3}$ that is the shortest distance between the first neck wall 393*a* and the second neck wall 393*b*.

The first aperture portion width $W_{AP1}$ may be greater than third aperture portion width $W_{AP3}$. The second aperture portion width $W_{AP2}$ may be greater than third aperture portion width $W_{AP3}$. In a preferred embodiment, the first aperture portion width $W_{AP1}$ and the second aperture portion width $W_{AP2}$ is greater than third aperture portion width $W_{AP3}$—thereby resulting in a "peanut" shape for the aperture 305. The third aperture portion width $W_{AP3}$ may be smaller than the average diameter of a hair whisker. The third aperture portion width $W_{AP3}$ may be greater than the average diameter of a hair whisker. The third aperture portion width $W_{AP3}$ may be substantially equal to the average diameter of a hair whisker.

In some embodiments, the third aperture portion width $W_{AP3}$ being smaller than the first and second aperture portion widths $W_{AP1}$, $W_{AP2}$; and the first and second aperture portion widths $W_{AP1}$, $W_{AP2}$ being larger than the average diameter of a hair whisker results in the third aperture portion width $W_{AP3}$ being small enough to prevent skin from being pinched between the cutting edge 307 and the fixed blade at the neck aperture portion 383, while still allowing hair whiskers to enter the first aperture portion 381 and/or the second aperture portion 382.

The first aperture portion 381 may comprise a first center point C1. The second aperture portion 382 may comprise a second center point C2. The first center point C1 and the second center point C2 may intersect the major axis M1 and be located on opposite sides of the minor axis M2. The first and second center points C1, C2 may be spaced equally from minor axis M2, resulting in the first and second center points C1, C2 being mirrored from each other. The first and second center points C1, C2 may be spaced unequally from the minor axis M2, resulting in an unsymmetrical peanut shaped aperture.

Referring now to FIG. 25, the cutter tube 301 may comprise a plurality of the peanut shaped apertures 305. The plurality of peanut shaped apertures 305 may be oriented into a plurality of rows 309. The major axis M1 and the minor axis M2 of each aperture 305 may be oriented oblique to a reference center line RCL on the outer surface 302 of the cutter tube 301 (which is also the outer surface of the rotary cutter 300).

As exemplified, the plurality of rows 309 are oriented such that a reference row line RRL connecting the centers C1, C2 of the apertures 305 in any given row 309 is parallel to the rotational axis R-R. Thus, the plurality of rows 309 in the exemplified embodiment can be considered axial rows. In other embodiments, the plurality of rows 309 can be oriented such that the reference row line RRL is at an acute angle (or otherwise inclined) relative to rotational axis R-R.

Each row 309 comprises a plurality of first apertures 340 and second apertures 341. For a single row 309, the first center C1 of the first aperture 340 falls on the reference row line RRL while the second center C2 of the second aperture 341 falls on the same reference row line RRL. Alternatively, the second center C2 of the first aperture 340 falls on the reference row line RRL while the first center C1 of the second aperture 341 falls on the same reference row line. Under this configuration, an overlapping pattern of adjacent rows 309 are created, wherein the first aperture 340 of a first row can be at least partially positioned between two second apertures 341 of a second row that is adjacent to the first row along the direction of the reference row line RRL.

For example, the plurality of apertures 305 may include a first row 309*a* having a first reference row line RRL1 that intersects both the first center C1*a* of the first aperture 340 of the first row 309*a* and the second center C2*a* of the second aperture 341 of the first row 309*a*. The plurality of apertures 305 may further include a second row 309*c* having a second reference row line RRL2, which is substantially parallel to the first reference row line RRL1, the second reference row line RRL2 intersecting the first center C1*c* of the first aperture 340 of the second row 309*c* and the second center C2*c* of the second aperture 341 of the second row 309*c*. An intermediate reference row line RRL3, which is substantially parallel to both the first and second reference row lines RRL1, RRL2 and is located there-between, intersects both the second center C2*b* of the first aperture 340 of the first row 309*a* and the first center C1*b* of the second aperture 341 of the second row 309*c*. The result is a plurality of first and second apertures 340, 341 that create a zig-zag pattern across the cutter tube 301.

As demonstrated by FIG. 26, the peanut shaped aperture 305 may comprise a cutting edge 307 that may be serrated. Specifically, the serrated cutting edge 307 comprises a plurality of alternating valleys and apexes that create a repeating jagged edge, or saw-like cutting edge 307. Non-limiting examples of valleys include semi-circles or concave V-shaped voids. Non-limiting examples of apexes include flat tops or convex V-shaped blades. The serrated cutting edge 307 provides superior shearing of whiskers that have entered the aperture 305 during use.

Figure 28:
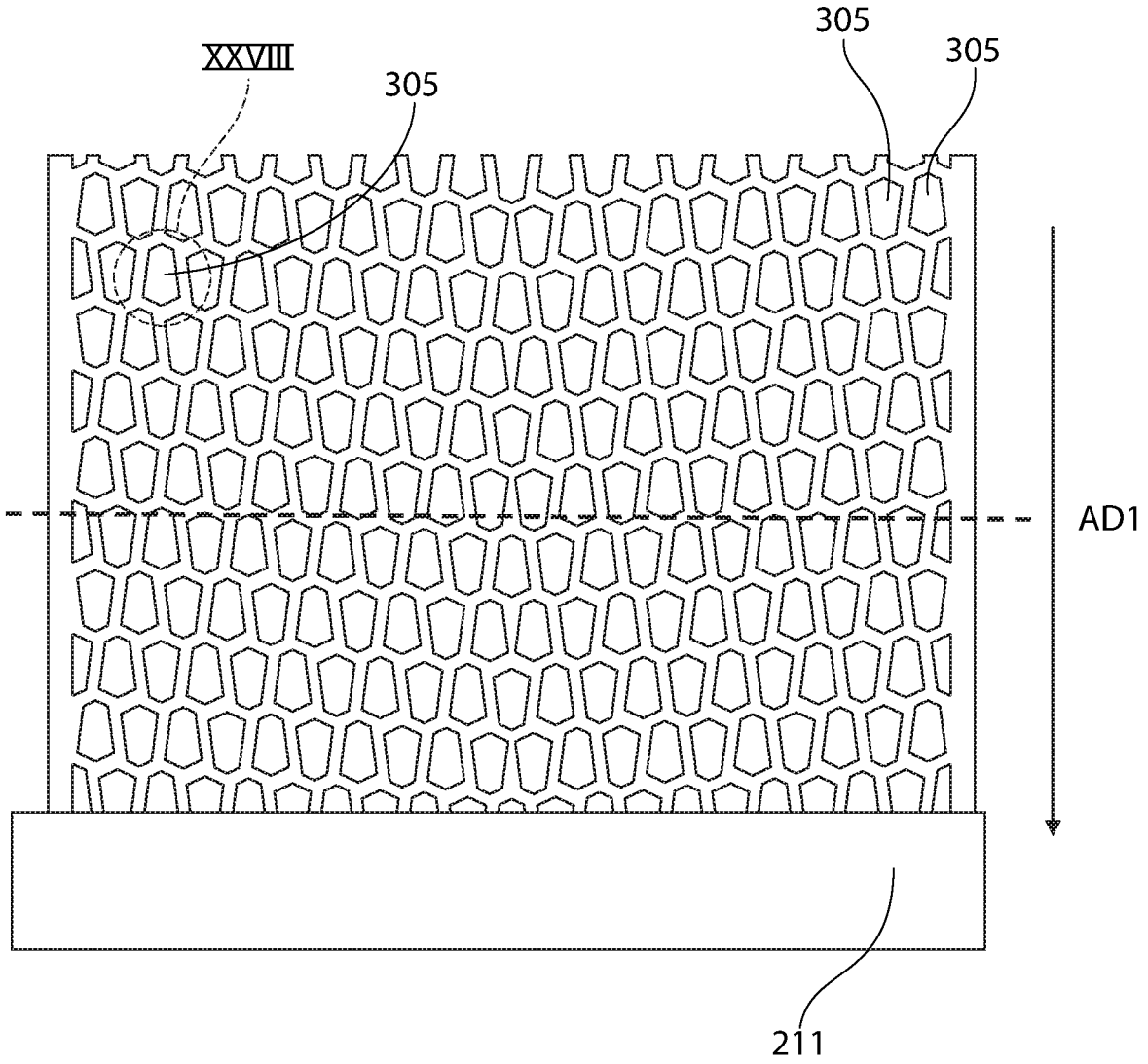
FIG. 28 is a two-dimensional plan view of an exemplary rotary cutter having an alternative pattern of apertures that can be used with the shaving apparatus of the present invention.

The serrated cutting edge 307 is suitable not just for the peanut shaped aperture 305, but a wide variety of apertures 305—including, but not limited to, circular apertures, ovular apertures, and polygonal apertures (such as the apertures 305 shown in FIG. 28).

Figure 27:
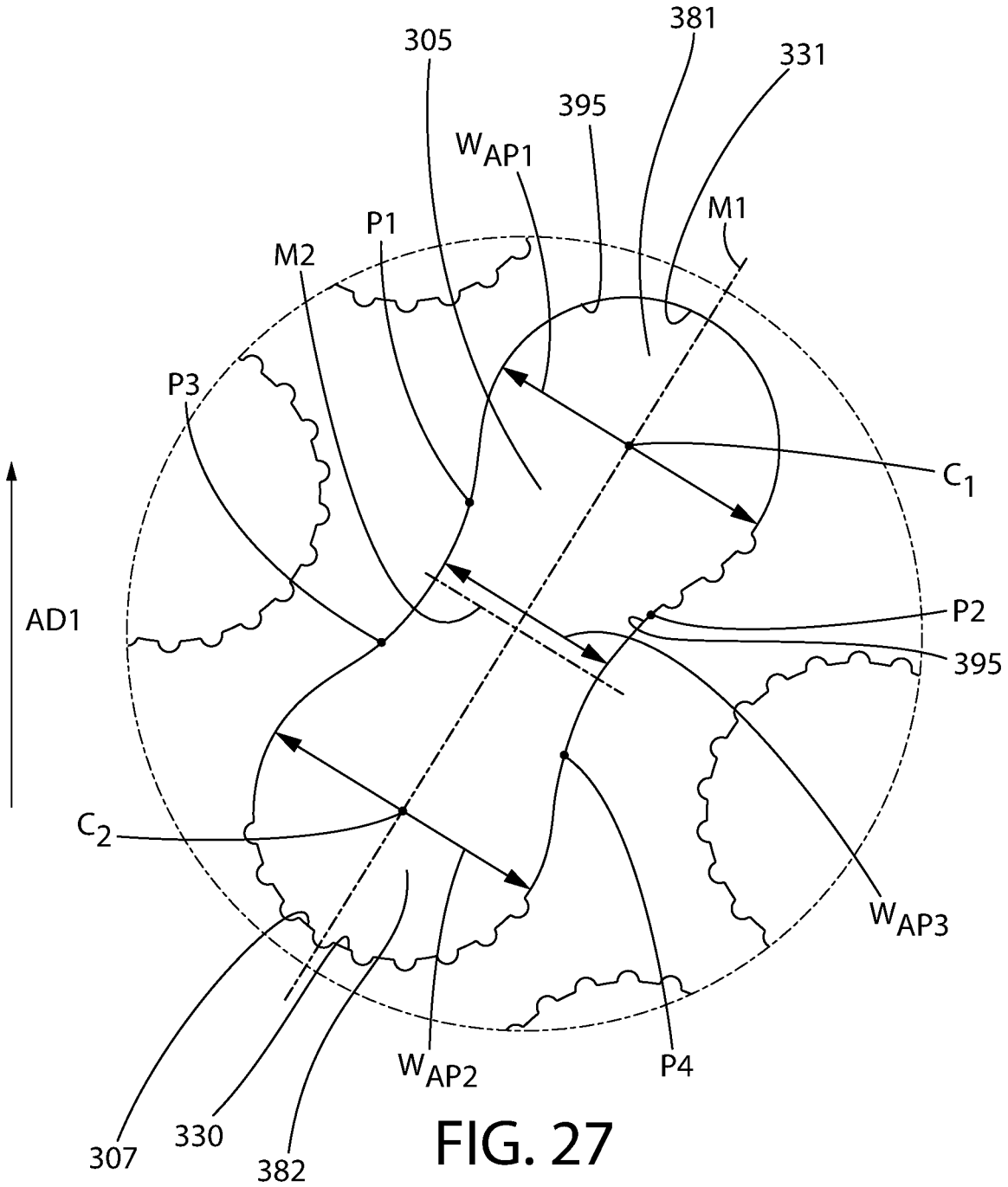
FIG. 27 is an alternate embodiment of the area XXVI of FIG. 25.

Additionally, referring to FIG. 27, the serrated edges may extend along less than 100% of the cutting edge 307 of the aperture 305. In some embodiments, 20% to 100% of the cutting edge 307 may be serrated—including all percentages and sub-ranges there-between. In some embodiments, an aperture may have less than 20% of the cutting edge serrated. In some embodiments, the cutting edge may have 20%, 35%, 50%, 75%, 90%, or 100% of the cutting edge serrated.

In an embodiment, for example the embodiment shown in FIG. 27, the serrated edges are along the portions 330 of the aperture that function as a shearing member in the shearing system when a whisker or object has entered the aperture. That is, the sections of the aperture that function in the shearing system, are the sections that are approximately parallel to the fixed blade when the sheared object is in between them. In an embodiment, approximately parallel refers to less than 45, 30, 15, 10, 5 degrees. In an embodiment, the serration dimensions are on the order of the hair diameter. The serration dimensions include the serration pitch, depth and opening width. The non-serrated portions of the example in FIG. 27 are indicated as 395. It is noted that the areas shown as 330 and 395 in FIG. 27 are just exemplary and are not limiting. Other embodiments can have a different ratio of serrated to non-serrated portions. For example, other embodiments can have more of the serrated portions 330 or they can have more of the non-serrated portions 395. Serrated portions can be more expensive to manufacture and, as a result, it can be advantageous to minimize the amount of serrated portions. However, serrated portions can provide better grabbing, pulling, and/or cutting of the whiskers so it may be advantageous to maximize the amount of serrated portions in areas of the aperture that take part in the grabbing, pulling, and/or cutting functions. These two completing factors can result in different amounts of serrated portions being used in different shaped apertures, or even the same shaped aperture, depending on the relative importance of cost and performance of the device. FIG. 27 shows only one aperture 305 having both serrated and non-serrated portions, however, all of the apertures can have the same design as to which sections are serrated and which are non-serrated, or different ones of the apertures 305 can have different designs as to serrated and non-serrated portions. In the case of an aperture pattern such as that shown in FIG. 25, some embodiments provide the serrated portions on those portions of apertures 305 that are involved in the grabbing, pulling and/or cutting action on the whiskers. This condition will result, for example, in particular ones of the apertures 305 being mirror images of other ones of the apertures 305 as it relates to which portions are serrated and which portions are non-serrated.

Figure 29A:
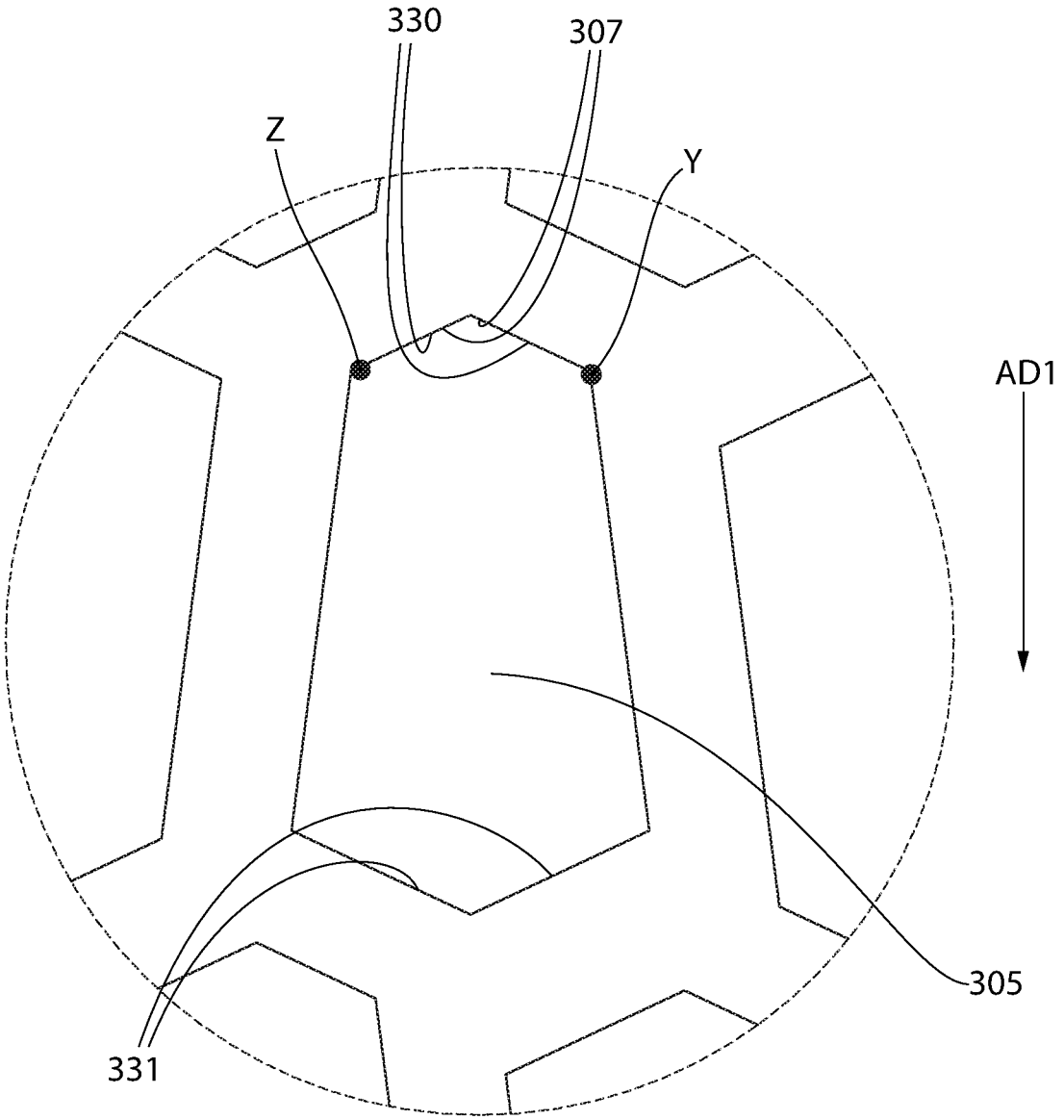
FIG. 29A is a close-up view of area XXVIII of FIG. 28.
Figure 29B:
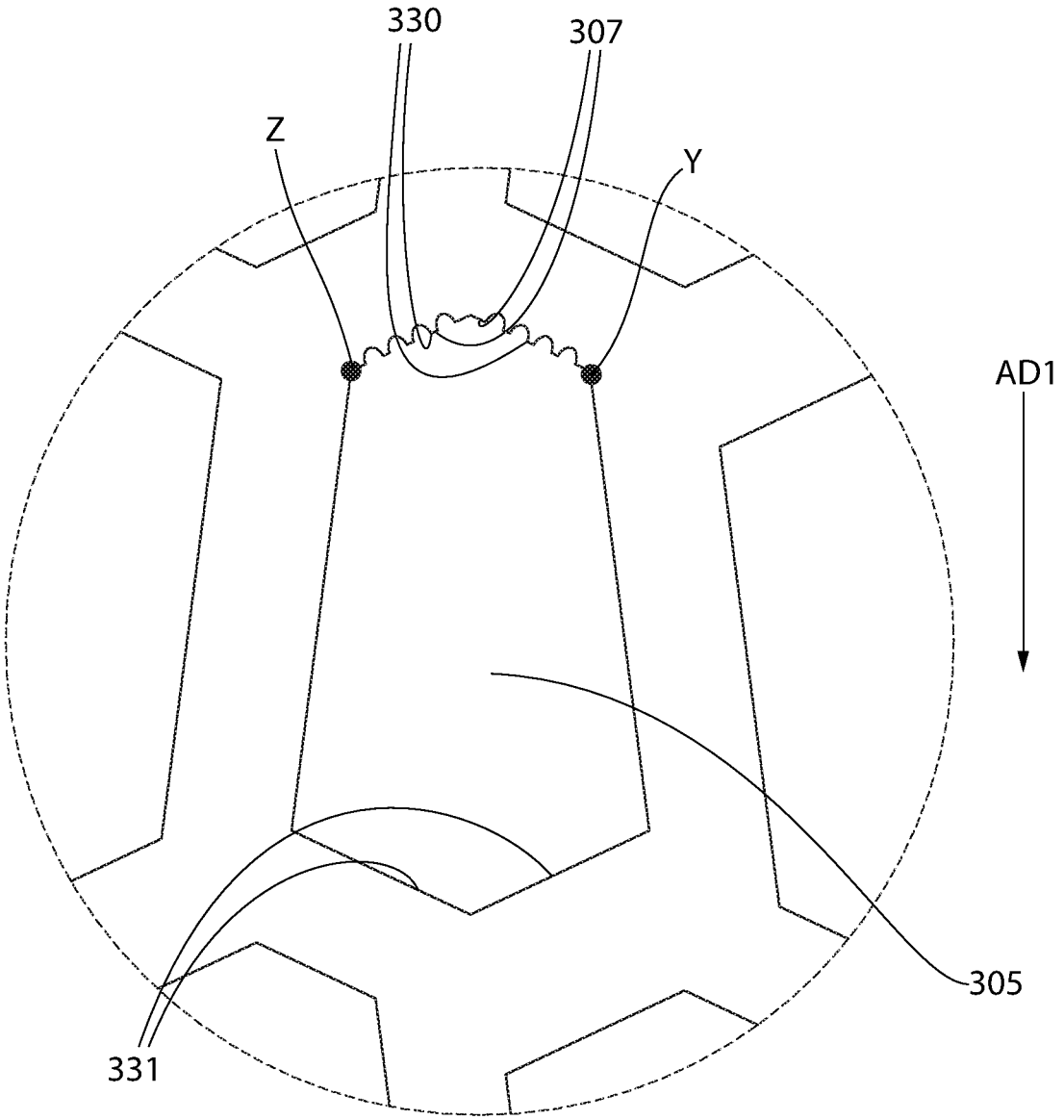
FIG. 29B is a close up view of an alternate embodiment of area XXVIII of FIG. 28.

Referring now to FIGS. 25-29B concurrently, depending on how the aperture 305 is positioned on the rotary cutter 300, each the cutting edge 307 of each aperture may comprise a shearing portion 330 and a non-shearing portion 331. Specifically, each aperture 305 is defined by a cutting edge 307 that defines a closed-geometry. Each of the cutting edges 307 comprises a shearing portion 330 and a non-shearing portion 331. In the exemplified embodiments in which the rotary cutter 300 is rotated about the rotational axis R-R in the angular direction AD1, the shearing portion 330 include the second cutting edge portion 382 of the peanut shaped aperture 305 (as shown in FIG. 26) as well as the surface that extends from point Y to point Z on the polygonal aperture of FIGS. 29A and 29B. The non-shearing portion 331 may comprise at least the first cutting edge portion 381 of the peanut shaped aperture 305 (as shown in FIG. 26) as well as the surfaces 331 on the polygonal aperture of FIGS. 29A and 29B. In addition, the shearing portion 330 (and/or other portions) of the aperture 305 in FIGS. 29A and 29B can be partially or completely serrated. FIG. 29A shows the aperture 305 as having no serrations, while FIG. 29B shows portions being serrated. In the exemplary embodiment shown in FIG. 29B, the shearing portion 330 between points Y and Z is completely serrated while all other edges of the aperture are non-serrated. In another embodiment, all of the edges of the aperture 305 in FIG. 29 A except the non-shearing portions 331 are serrated while the non-shearing portions 331 are non-serrated. In still other embodiments, other combinations of serrated and non-serrated portions are used. These configurations balance the added cost of serrating an edge with the benefits gained from serration.

The apertures 305 shown in FIGS. 28, 29A and 29B can, as described above, have a shearing portion located between points Y and Z, or can have a shearing portion that is only a part of the edges between points Y and Z. Further, a portion of one or both of the sides extending downward in FIG. 29A from points Y and Z can be shearing portions and, as such, can be either serrated, partially serrated, or non-serrated. It is also noted that those portions of the cutting edge of the aperture shown in FIG. 29A that are shearing portions can be the same for all of the apertures shown in FIG. 28. Alternatively, a first group of apertures that have their smaller ends facing in the direction of arrow AD1 can have the same shearing portion locations, whereas a second group of apertures having their smaller ends facing opposite to the direction of arrow AD1 can have shearing portion locations that are the same as each other, but are different than those of the first group of apertures. For example, those areas that are shearing portions on the first group of apertures can be non-shearing portions on the second group of apertures. And, those areas that are non-shearing portions on the first group of apertures can be shearing portions on the second group of apertures.

The apertures 305 shown in FIGS. 28, 29A and 29B are just one example of possible aperture shapes. For example, other polygons having any number of sides, or other non-poygonal shapes can be used. In addition, the aperture axes of the apertures can be parallel to the rotating direction of the cutter tube or can be offset at an angle relative to the rotating direction of the cutter tube.

Figure 30:
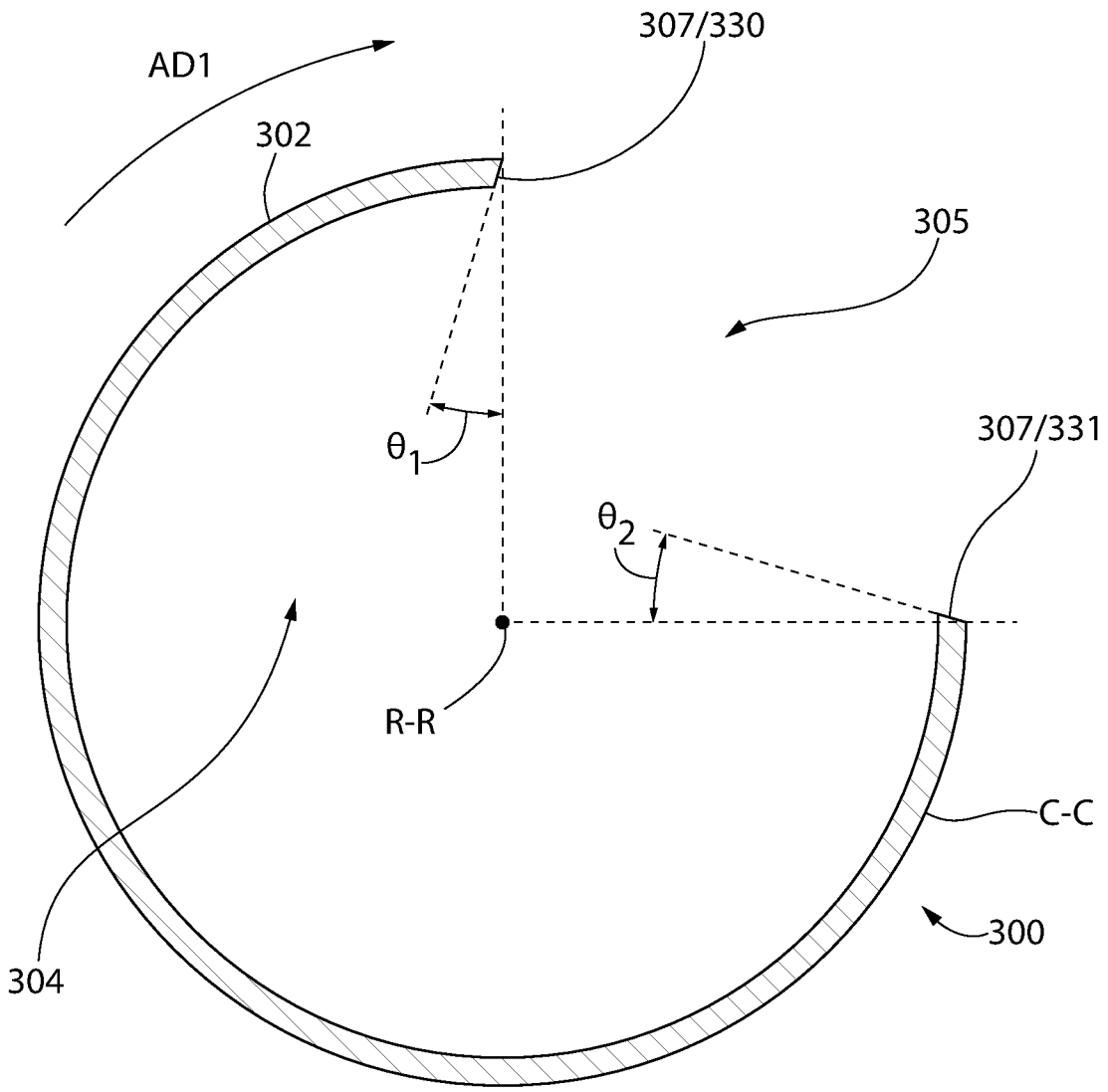
FIG. 30 is cross-sectional view of an exemplary rotary cutter of a head portion of the shaving apparatus.

Referring now to FIG. 30, the rotary cutter 300 is of a hollow cylindrical configuration. The rotary cutter 300 comprises a hollow cutter tube having an outer surface 302 and an inner surface. The rotary cutter 300 comprises an internal cavity 304 which, in the exemplified embodiment, is formed by the inner surface of the cutter tube about a central axis, which is also the rotary axis R-R of the rotary cutter 300. The internal cavity 304 of the rotary cutter 300 can be dimensioned to receive a motor and inline drive train.

The rotary cutter 300 further comprises a plurality of apertures 305 formed in the outer surface 302 of the cutter tube. The outer surface 302 of the cutter tube defines a reference cylinder (delineated by circle C-C) that is concentric to the rotational axis R-R of the rotary cutter 300.

Each of the apertures 305 is defined by a cutting edge 307 having a closed-geometry. The cutting edges 307 of the cutting tube, in certain embodiments, may be formed by the intersection of the outer surface 302 of the cutter tube and the radial walls that circumscribe the apertures 305. The rotary cutter spins as indicated by the arrow AD1 in FIG. 30, thereby causing the cutting edges 307 to comprise a shearing portion 330 and a non-shearing portion 331.

According to the present invention, the shearing portion 330 may comprise a first surface that is positioned at a first angle Ø1 relative to the radius extending from the central point of the cutting tube (as indicated by R-R). The first angle Ø1 is an inclusive acute angle that may range from about 5 degrees to about 40 degrees—including all values and sub-ranges there-between. In a preferred embodiment, the first angle Ø1 may be about 10 degrees. In another preferred embodiment, the first angle Ø1 may be about 25 degrees. In a preferred embodiment, the first angle Ø1 may be about 35 degrees.

According to the present invention, the non-shearing portion 331 may comprise a second outer surface that is positioned at a second angle Ø2 relative to the radius extending from the central point of the cutting tube (as indicated by R-R). The second angle Ø2 is a non-inclusive acute angle that may range from about 5 degrees to about 40 degrees—including all values and sub-ranges there-between. In a preferred embodiment, the second angle Ø2 may be about 10 degrees. In another preferred embodiment, the second angle Ø2 may be about 25 degrees. In a preferred embodiment, the second angle Ø2 may be about 35 degrees. The first angle Ø1 may be the same or different than the second angle Ø2.

Features of the present invention may be implemented in software, hardware, firmware, or combinations thereof. The computer programs described herein are not limited to any particular embodiment, and be executed on a single or multiple processors.

Processors described herein may be any central processing unit (CPU), microprocessor, micro-controller, computational, or programmable device or circuit configured for executing computer program instructions (e.g., code). Various processors may be embodied in computer and/or server hardware of any suitable type (e.g., desktop, laptop, notebook, tablets, cellular phones, etc.) and may include all the usual ancillary components necessary to form a functional data processing device including without limitation a bus, software and data storage such as volatile and non-volatile memory, input/output devices, graphical user interfaces (GUIs), removable data storage, and wired and/or wireless communication interface devices including Wi-Fi, Bluetooth, LAN, etc.

Computer-executable instructions or programs (e.g., software or code) and data described herein may be programmed into and tangibly embodied in a non-transitory computer-readable medium that is accessible to and retrievable by a respective processor as described herein which configures and directs the processor to perform the desired functions and processes by executing the instructions encoded in the medium. A device embodying a programmable processor configured to such non-transitory computer-executable instructions or programs may be referred to as a "programmable device", or "device", and multiple programmable devices in mutual communication may be referred to as a "programmable system." It should be noted that non-transitory "computer-readable medium" as described herein may include, without limitation, any suitable volatile or non-volatile memory including random access memory (RAM) and various types thereof, read-only memory (ROM) and various types thereof, USB flash memory, and magnetic or optical data storage devices (e.g., internal/external hard disks, floppy discs, magnetic tape CD-ROM, DVD-ROM, optical disk, ZIP™ drive, Blu-ray disk, and others), which may be written to and/or read by a processor operably connected to the medium.

In certain embodiments, the present invention may be embodied in the form of computer-implemented processes and apparatuses such as processor-based data processing and communication systems or computer systems for practicing those processes. The present invention may also be embodied in the form of software or computer program code embodied in a non-transitory computer-readable storage medium, which when loaded into and executed by the data processing and communications systems or computer systems, the computer program code segments configure the processor to create specific logic circuits configured for implementing the processes.

Embodiments of the invention can include a control circuit or controller for controlling various functions of the shaving apparatus. The control circuit disclosed herein can be used with a variety of electronic shaving apparatuses. In one embodiment, the shaving apparatus includes a rotary cutter and a fixed blade that are used to shear a user's hairs there between during a shaving process. Rotation of the rotary cutter is driven by an electric motor. A control circuit is included that can control the electric motor to selectively rotate the rotary cutter in either the clockwise direction or the counter-clockwise direction. The ability to selectively rotate the rotary cutter in both the clockwise and counter-clockwise direction can be utilized for a variety of end goals, including without limitation bi-directional shaving, the preparation of hairs for shearing, safety, protecting the apparatus from damage, and combinations thereof.

In the exemplified embodiment, the electric motor is operably coupled to the power source and the rotary cutter, and a control circuit is operably coupled to the electric motor and the power source. The control circuit is configured to selectively (1) rotate the rotary cutter about the rotational axis in a first rotational direction so that a user's hairs are sheared between the first cutting edge of the first fixed blade and the first cutting edges of the rotary cutter; and (2) rotate the rotary cutter about the rotational axis in a second rotational direction, the second rotational direction being opposite the first rotational direction.

According to the exemplified embodiment, when the rotary cutter 220 is mounted within the head 200 and rotated by the motor 130, the user's hairs extend into the apertures 305 and are sheared between the cutting edges 307 and the cutting edge of the fixed blade 211 during a shaving operation. When the head 200 is assembled for use, the motor 130 is positioned in the central cavity of the rotary cutter 220 and operably coupled thereto so as to be capable of rotating the rotary cutter 220 about the rotational axis R-R. According to some embodiments of the present invention, the motor 130 is an electric motor and is electrically coupled to the power source 140 housed in the handle 100 as described above. The motor 130 can be powered by alternating or direct current. In certain embodiments, the motor 130 may be a brushless type motor or a brushed motor type; and/or may be a cored or coreless type motor. In certain other embodiments, the motor 130 may be a stepper motor. As discussed in greater detail below, in certain embodiments, the motor 130 may be capable of selectively rotating in both the clockwise and counter-clockwise directions.

One suitable motor may be a brushless DC electric motor, which is a synchronous electric motor that is powered by direct-current electricity and has an electronically controlled commutation system (a "controller") instead of a mechanical commutation system based on brushes, as present in the brushed motors. It is noted herein that the term "motor" is intended to encompass the assembly of parts which transform electrical power to mechanical motion as a required output force/torque and speed.

An inline drive train, which may be omitted in certain embodiments, can be provided to control the output speed and torque of the electric motor 130. Other embodiments include drive trains other than in-line drive trains. The inline drive train is a drive transmission device, such as a gear box, which is placed in-line with the motor 130, namely the drive shaft of the motor 130 and the output shaft of inline drive train may share the same axis of rotation. The inline drive train may include be epicyclic gearing, or planetary gearing. Such an inline gearing system can be selected so as to increase the torque of the motor and reduce its speed or the opposite, depending on the selected motor and desired terminal rotation output. Other drive trains can be located in the handle portion and can include one or more gears and/or one or more belts to transmit the rotation of the motor to the rotary cutter.

A coupling element is coupled (directly or indirectly) to the electric motor 130 and to the cutter tube of the rotary cutter 220 so that rotational output of the electric motor 130 is transmitted to the cutter tube of the rotary cutter 220 by the coupling element. In the exemplified embodiment, the coupling element is coupled to the output shaft of the inline drive train (which in turn is operably coupled to the motor 130) and an end portion of the cutter tube of the rotary cutter 220. In certain other embodiments, the coupling element may be coupled to the electric motor 130 directly (for example, through the drive shaft or other rotating output). In still other embodiments, additional intervening drive transmission devices may be utilized.

Once the motor 130, the inline drive train, and the coupling element are assembled, first and second rotary cutter end caps are coupled thereto. The first rotary cutter end cap fits within a first end of the cutter tube of the rotary cutter 220 and comprises an annular body and a hollow post. An axial passageway is formed through the first rotary cutter end cap so that electrical connectors which, in the exemplified embodiment are wires, can pass there through to couple to contacts of the motor 130.

Shaving apparatus 1000 can include a control circuit to facilitate selective bi-directional rotation of the rotary cutter 220 according to an embodiment of the present invention. The ability to selectively rotate the rotary cutter 220 in both the clockwise and counter-clockwise directions (i.e., bidirectional rotation) can be utilized for a variety of end goals, including without limitation bi-directional shaving, the preparation of hairs for shearing, safety, protection of the apparatus from damage, and combinations thereof.

The control circuit, in the exemplified embodiment, generally comprises, in operable coupling and communication, a user-operated actuator 110, a controller 120, a memory device (either as a part of the controller 120, or as a separate device), a current sensing circuit, a switch, and a user-perceptible output device. In the exemplified embodiment, the control circuit is sufficiently sophisticated so as to be capable of automated control of the rotational, direction of the rotary cutter 220 (via the electric motor 130) to accomplish bidirectional shaving using an automated oscillating action of the rotary cutter 220, an automated safety routine that is carried out upon the electric motor 130 drawings too much current, and an automated safety routine that is carried out upon the shaving apparatus 1000 being powered down or when the power source 140 reaches a discharged state.

The control circuit is configured to selectively: (1) rotate the rotary cutter 220 about the rotational axis R-R in a first rotational direction; and (2) rotate the rotary cutter about the rotational axis in a second rotational direction opposite the first rotational direction. As discussed in greater detail below, depending on the desired functionality to which this bi-directional rotation of the rotary cutter 220 is to be put, the control circuit can be configured to select between the first and second either automatically or manually by the user manipulation of the user-operated actuator 110.

The current sensing circuit can by operably coupled to the electric motor 130 and the power source 140 so that current being drawn by the electric motor 130 from the power source 140 is sensed (i.e., monitored). As is generally known, the current drawn by an electric motor increase with increased load. The loads on the system can include normal operation loads, such as the required torque to rotate the rotary cutter, the friction forces within the shaving apparatus, friction forces due to mounting the fixed blade such that it is biased in contact with the rotary cutter during rotation, and the force required to shear the whiskers during the shearing process. Increased current being drawn by the electric motor 130 may be the result of several factors, including dulling of the cutting edges (of the fixed blade 211 and/or the rotary cutter 220); the rotary cutter 220 and the first fixed blade 211 not being positioned in proper relationship with each other; hair being only pinched rather than sheared effectively or completely; the build-up of soap residue or hairs in the head 200 in sections of the head 200 that affect the ability of the rotary cutter 220 to rotate.

In one embodiment, the current sensing circuit continuously monitors the current being drawn and upon detecting a surge in the current being drawn by the electric motor 130, the controller 120 can stop rotation of the rotary cutter 220 by, for example opening a switch to cut off power from going to the electric motor 140. In such a circumstance, the user-perceptible device can also (or alternatively) provide notice of the current condition. In one embodiment, a surge is detected if a current level exceeds a predetermined current level threshold. In another embodiment, a surge can be detected if there is a slope or gradient in the current being drawn by the electric motor 130 (irrespective of the empirical value). In one embodiment, the value (whether empirical or slope) that qualifies as surge can be set by the user. In yet other embodiments (discussed below), the system can monitor whether the current is outside a predetermined range, or whether the current has another predetermined characteristic. In particular embodiments, all of the devices work jointly or independently, or any combination thereof, to notify the user of the current condition.

In one embodiment, upon the current sensing circuit detecting that the current being drawn from the power source 140 by the electric motor 130 surges (or is outside a predetermined range) while the rotary cutter 220 is rotating in a current rotational direction, the control circuit will reverse rotation, thereby rotating the rotary cutter 220 in the opposite rotational direction a predetermined angle. Changing motor direction would alleviate any pinching of the skin or hair, and may also release residue buildup. The control circuit may, or may not, then shut down the electric motor 130.

The exemplified control circuit comprises a user-perceptible output device operably coupled to the controller 120. In one embodiment, when the current sensing circuit detects that a surge has occurred, the controller 120 activates the user-perceptible output device. The user-perceptible output device can be a light, a display screen, or other device that creates sound, vibration, or a visual cue, or any combination thereof. This can be an indication to the user that the shaving head should be cleaned, maintained, and/or the fixed blade and/or the rotary cutter replaced. Alternatively, the user-perceptible output device can indicate that the system is operating properly (e.g., a green light indicating the apparatus is operating within a proper predetermined current range).

The monitoring of the drawn current can be based upon the state the shaving apparatus is in. For example, in a first state the apparatus is in operation but the fixed blade has not been mounted. In a second state, the apparatus is in operation and the fixed blade is mounted, but shaving has not begun. In a third state, the apparatus is in operation, the fixed blade is mounted, and shaving is occurring. Each state can have its own predetermined current range or threshold.

A variety of means can be used to determine which state the shaving apparatus is currently in. For example, a sensing element, such as a mechanical device, can indicate whether a disposable blade is on or off (to distinguish between the first and second states). Further, a sensing element can indicate whether shaving is occurring. Such a sensing element can, for example, be configured to sense contact with the face.

For each state, a threshold and/or range of current levels can be defined to characterize a system that is functioning properly. In the first state (for example, prior to mounting the fixed blade), a first current range or threshold can determine whether the general system is functioning well and is ready for use, or is not in condition for operation.

In the second state (for example, when the fixed blade is mounted), a second current range or threshold can determine whether the fixed blade is causing improper friction with the rotary cutter or is otherwise not operating correctly. For example, if the fixed blade is not in proper contact with the rotary cutter or has come loose, the sensed current will fall below the predetermined range. Similarly, if the blade is causing too much friction with the rotary cutter, the sensed current will be above the predetermined range.

In the third state (for example, during shaving), a third current range or threshold can determine, for example, whether an improper load is being caused by the shaving process. An improper load can be caused by the user pressing the rotary cutter too hard against the skin. In such a case, the sensed current will be above the predetermined range or threshold.

Figure 31:
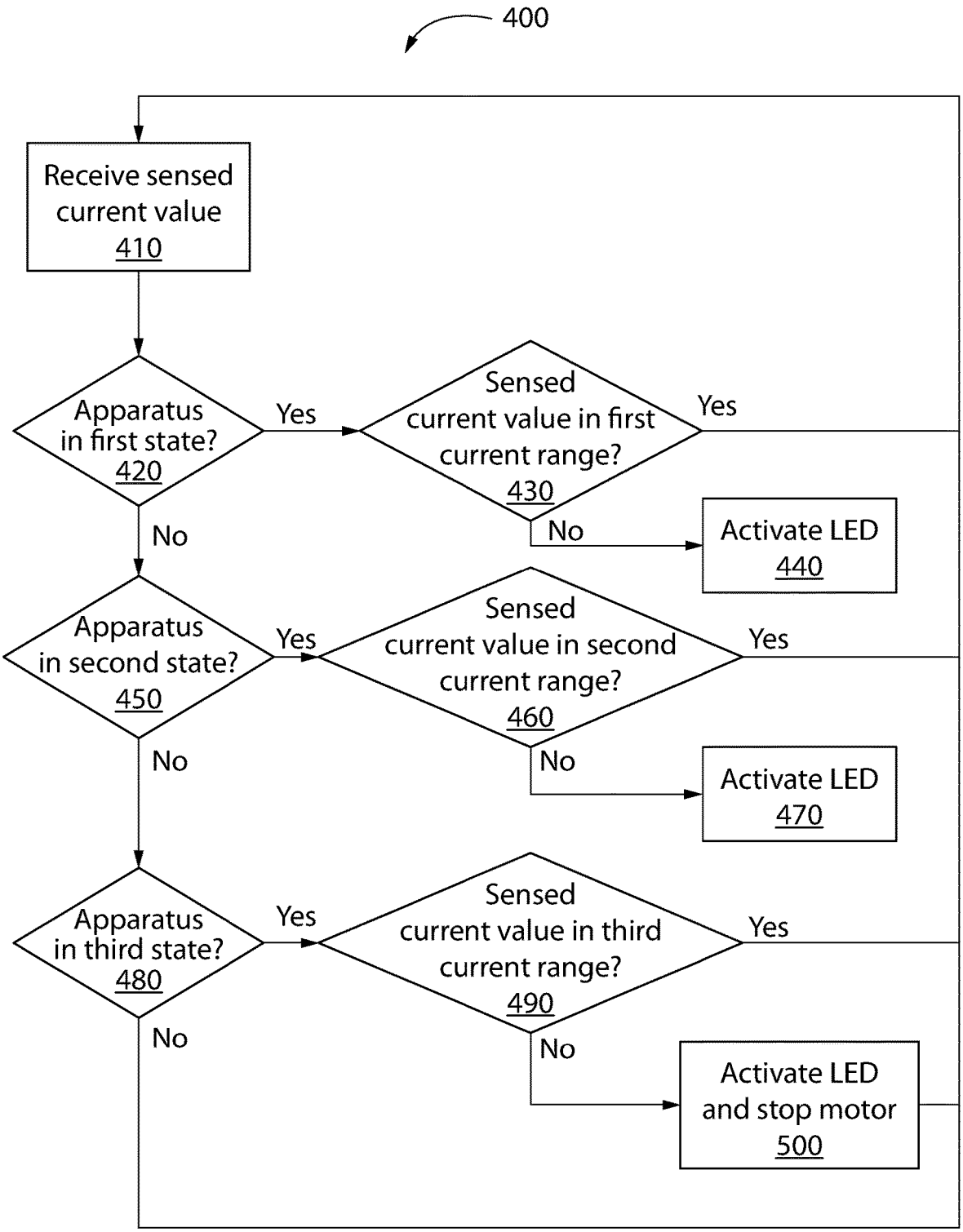
FIG. 31 is a flow chart for a method for controlling a shaving apparatus according to an exemplary embodiment of the invention.

In the above states, when the current is outside the relevant predetermined current range, the user-perceptible output device (e.g., a red LED) can indicate a problem and/or stop the motor 130. FIG. 31 is a flow chart for a method 400 for controlling a shaving apparatus according to one embodiment. In this embodiment, once the motor 130 is started, the control circuit receives a sensed current value from the current sensing circuit (operation 410). There is a determination whether the apparatus is in the first state (operation 420). If it is, there is a determination whether the sensed current value is in the first current range (operation 430). If it is, operation continues and the newest sensed current value is received (operation 410). If it is not, the user perceptible output device (e.g., LED) is activated to alert the user (operation 440).

If the apparatus is not in the first state, there is a determination whether the apparatus is in the second state (operation 450). If it is, there is a determination whether the sensed current value is in the second current range (operation 460). If it is, operation continues and the newest sensed current value is received (operation 410). If it is not, the user perceptible output device (e.g., LED) is activated to alert the user (operation 470).

If the apparatus is not in the second state, there is a determination whether the apparatus is in the third state (operation 480). If it is, there is a determination whether the sensed current value is in the third current range (operation 490). If it is, operation continues and the newest sensed current value is received (operation 410). If it is not, the user perceptible output device (e.g., LED) is activated and the motor is stopped to protect the user and the apparatus (operation 500). In other embodiments, other outcomes (or combinations of outcomes) can result from the current being outside the predetermined ranges or thresholds.

Alternatively, an additional current range or threshold can be used to determine whether an extreme load is present that requires stopping the motor. For example, such a range can be indicative of a large number of whiskers being cut simultaneously, or the skin being pinched.

As indicated above, the control circuit can also be configured to reverse the direction of rotation of the rotary cutter when the sensed current is outside a predetermined range or threshold. For example, the reverse motion can be 1, 2, 5, 10, 30, 60, 90, 120, or 180 degrees of rotation.

The predetermined ranges and/or threshold can be made configurable. The configuration of the ranges or threshold can be based on factors such as user characteristic, type of blade being used, and the state or age of the system, blade, or rotary cutter. Further, any of the predetermined current ranges can be configured to overlap with one or more other current ranges.

While the above example uses the presence, absence, or condition of the fixed blade as a condition being sensed, it is noted that other conditions can be also, or alternatively, sensed. For example, the presence, absence, or condition of the rotary cutter can be sensed.

Figure 32:
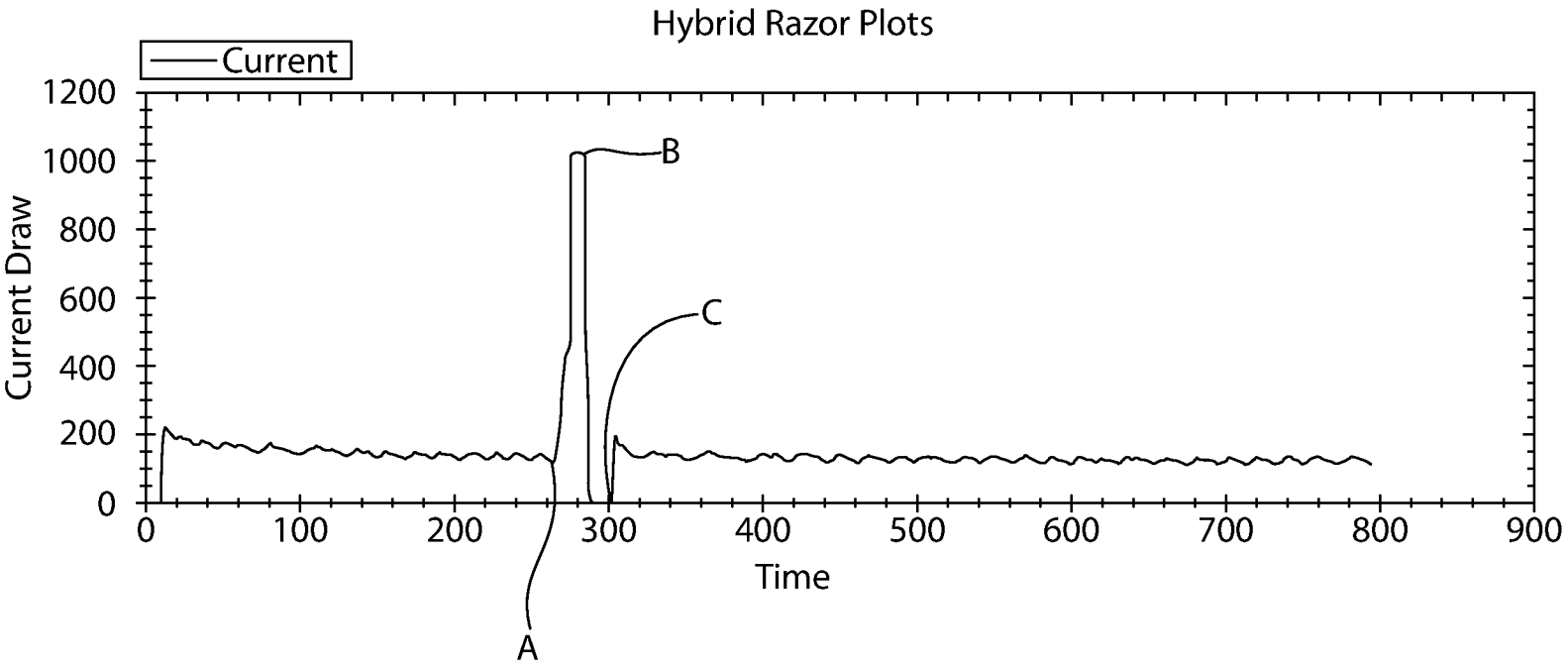
FIG. 32 is a graph showing the monitoring of current drawn by a shaving apparatus according to an embodiment of the invention.

FIG. 32 is a graph showing the monitoring of current drawn by a shaving apparatus according to one embodiment. A surge in current is shown beginning at point A where the current increases rapidly to point B. In response, the control circuit causes the motor to stop, thereby decreasing the current to zero at point C. Subsequently, the motor is turned back on and operates and a normal current level.

Figure 33:
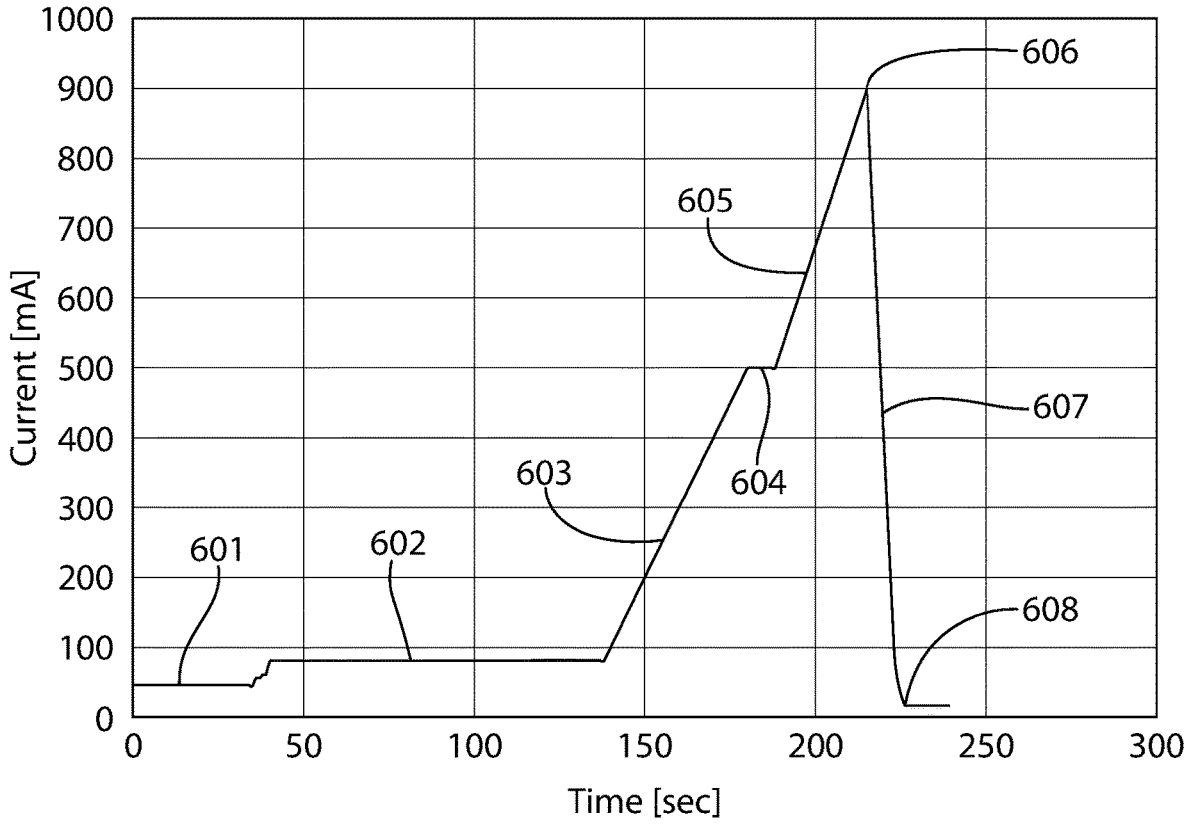
FIG. 33 is graph showing the monitoring of current drawn by a shaving apparatus according to another embodiment of the invention.

FIG. 33 is graph showing the monitoring of current drawn by a shaving apparatus according to another embodiment. The first portion 601 shows the current drawn when there is no blade attached to the shaving apparatus. The second portion 602 shows the current when the blade is attached, the current being slightly increased. The third portion 603 shows the current increasing due to an increase in load, for example, when shaving commences and whiskers are being sheared. In the fourth portion 604, the motor is running at a steady state speed. In the fifth portion 605, the current increases due to an addition load such as, for example, an issue with the shaving or the shaving apparatus. In the final portion, the current reaches a threshold 606 indicating an extreme load, which causes the motor to stop and the current to drop (607) to zero at 608.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A shaving apparatus comprising:

a rotary cutter configured to rotate about a first rotational axis and comprising a cutter tube, the cutter tube comprising a plurality of closed-geometry apertures in an outer surface of the cutter tube, each of the closed-geometry apertures having a cutting edge;

a brush located inside the cutter tube and configured to rotate about a second rotational axis;

a blade having a cutting edge, the blade mounted adjacent the rotary cutter;

an electric motor operably coupled to a power source and the rotary cutter to rotate the rotary cutter about the first rotational axis so that a user's hairs are sheared between the cutting edge of the blade and the cutting edges of the cutter tube;

wherein the first rotational axis is offset from the second rotational axis; and wherein the offset in the first and second rotational axes causes bristles of the brush to extend outside of the apertures at a first location on a circumference of the cutter tube and to not extend outside of the apertures at a second location on the circumference of the cutter tube.

2. The shaving apparatus of claim 1, wherein the blade is a fixed blade.

3. The shaving apparatus of claim 1, wherein the bristles extend radially from the second rotational axis.

4. The shaving apparatus of claim 3, wherein at least one of the bristles extends through one of the apertures for less than a complete rotation of the cutter tube.

5. The shaving apparatus of claim 4, wherein the bristles are U-shaped such that a curved section of each of the bristles are portions of the bristles that are furthest from a base structure of the brush.

6. The shaving apparatus of claim 1, wherein the first rotational axis is parallel to the second rotational axis.

7. The shaving apparatus of claim 1, wherein the first rotational axis and the second rotational axis are co-axial.

8. The shaving apparatus of claim 1, wherein the first location is distant from the cutting edge of the blade.

9. The shaving apparatus of claim 1, wherein the second location is adjacent the cutting edge of the blade.

10. The shaving apparatus of claim 1 about the second rotational axis.

11. The shaving apparatus of claim 1, wherein the rotary cutter and the brush rotate at a first rotational speed.

12. The shaving apparatus of claim 1, wherein the brush comprises a base structure and the bristles extending from the base structure.

13. The shaving apparatus of claim 1, wherein the brush has a first outer diameter, the cutter tube has a second outer diameter, and the first and second outer diameters are different.

14. The shaving apparatus comprising:

a rotary cutter configured to rotate about a first rotational axis and comprising a cutter tube, the cutter tube comprising a plurality of closed-geometry apertures in an outer surface of the cutter tube, each of the closed-geometry apertures having a cutting edge;

a brush located inside the cutter tube and configured to rotate about a second rotational axis; and a blade having a cutting edge, the blade mounted adjacent the rotary cutter; and an electric motor operably coupled to a power source and the rotary cutter to rotate the rotary cutter about the first rotational axis so that a user's hairs are sheared between the cutting edge of the blade and the cutting edges of the cutter tube; and wherein the rotary cutter rotates at a first rotational speed, the brush rotates at a second rotational speed, and the first and second rotational speeds are different.

15. A shaving apparatus comprising:

a rotary cutter configured to rotate about a first rotational axis and comprising a cutter tube, the cutter tube comprising a plurality of closed-geometry apertures in an outer surface of the cutter tube, each of the closed-geometry apertures having a cutting edge;

a brush located inside the cutter tube and configured to rotate about a second rotational axis;

a blade having a cutting edge, the blade mounted adjacent the rotary cutter;

an electric motor operably coupled to a power source and the rotary cutter to rotate the rotary cutter about the first rotational axis so that a user's hairs are sheared between the cutting edge of the blade and the cutting edges of the cutter tube; and wherein the brush comprises a plurality of base structures and a plurality of bristles extending from each of the base structures.

16. The shaving apparatus of claim 15, wherein the base structures are parallel rods.

* * * * *